US010316549B2

(12) United States Patent
Nye-Hingston et al.

(10) Patent No.: US 10,316,549 B2
(45) Date of Patent: Jun. 11, 2019

(54) LOCK

(71) Applicant: BQT SOLUTIONS (SEA) PTE LIMITED, Singapore (SG)

(72) Inventors: Matthew Richard Alex Nye-Hingston, Auckland (NZ); Ian Tristan Barnes, Pokeno (NZ); Neil Richard Hingston, Auckland (NZ)

(73) Assignee: BQT SOLUTIONS (SEA) PTE LIMITED, Singapore (SG)

( * ) Notice: Subject to any disclaimer, the term of this patent is extended or adjusted under 35 U.S.C. 154(b) by 1043 days.

(21) Appl. No.: 14/398,788

(22) PCT Filed: May 9, 2013

(86) PCT No.: PCT/IB2013/053737
§ 371 (c)(1),
(2) Date: Nov. 4, 2014

(87) PCT Pub. No.: WO2013/168114
PCT Pub. Date: Nov. 14, 2013

(65) Prior Publication Data

US 2015/0097380 A1 Apr. 9, 2015

(30) Foreign Application Priority Data

May 11, 2012 (NZ) ..... 599955

(51) Int. Cl.
*E05B 63/08* (2006.01)
*E05B 63/14* (2006.01)
(Continued)

(52) U.S. Cl.
CPC ..... *E05B 63/08* (2013.01); *E05B 15/022* (2013.01); *E05B 17/007* (2013.01);
(Continued)

(58) Field of Classification Search
CPC ..... Y10T 292/1021; Y10T 292/1082; Y10T 70/5155; Y10T 70/5199; Y10T 70/5372;
(Continued)

(56) References Cited

U.S. PATENT DOCUMENTS 2,325,225 A * 7/1943 Burke ..... E05B 47/023 292/201
3,751,088 A * 8/1973 Schlage ..... E05B 47/023 292/201

(Continued)

FOREIGN PATENT DOCUMENTS

EP 0799956 A2 10/1997
EP 1950364 A1 * 7/2008 ..... E05B 47/0012
GB 2230550 A 10/1990

OTHER PUBLICATIONS

International Search Report dated Sep. 12, 2013.

(Continued)

*Primary Examiner* — Alyson M Merlino
(74) *Attorney, Agent, or Firm* — Timothy M. McCarthy; Clark Hill PLC

(57) ABSTRACT

A lock for locking a door, the lock comprises a pin moveable between a retracted position and an extended position for locking the door and an actuator movable from a first position to a second position to move the pin from the retracted position to the extended position. Furthermore, the lock comprises a mechanism comprising a spring for biasing the pin to the retracted position and a latch. When in the latched position the latch prevents the pin from moving from the extended position to the retracted position, and when in an unlatched position the latch allows the pin to move from the extended position to the retracted position. The mechanism is adapted to disengage the actuator from the pin when the pin is in the extended position.

20 Claims, 11 Drawing Sheets

(51) Int. Cl.

| | |
|---|---|
| ***E05B 65/06*** | (2006.01) |
| ***E05B 47/00*** | (2006.01) |
| ***E05B 47/02*** | (2006.01) |
| ***E05B 15/02*** | (2006.01) |
| ***E05B 17/00*** | (2006.01) |

(52) U.S. Cl.
CPC ..... *E05B 47/0012* (2013.01); *E05B 47/023* (2013.01); *E05B 63/14* (2013.01); *E05B 65/06* (2013.01); *E05B 2047/0058* (2013.01); *E05B 2047/0068* (2013.01); *E05B 2047/0076* (2013.01); *Y10T 292/1082* (2015.04)

(58) Field of Classification Search
CPC ..... Y10T 70/7028; Y10T 70/7051; Y10T 70/7062; Y10T 70/7102; Y10T 70/7113; E05B 63/08; E05B 15/022; E05B 47/0012; E05B 47/023; E05B 47/0001; E05B 47/02; E05B 2047/0076; E05B 2047/0014; E05B 2047/0036; E05B 2047/0015; E05B 2047/0017; E05B 2047/0081; E05B 65/06
See application file for complete search history.

(56) References Cited

U.S. PATENT DOCUMENTS

| | | | | |
|---|---|---|---|---|
| 4,056,276 | A | 11/1977 | Jarvis | |
| 4,099,752 | A | 7/1978 | Geringer | |
| 4,237,711 | A * | 12/1980 | Kambic | E05B 47/023 292/223 |
| 5,113,676 | A | 5/1992 | Panosszin | |
| 5,566,991 | A * | 10/1996 | Young | E05B 47/0012 292/201 |
| 5,755,126 | A * | 5/1998 | Lanigan | E05B 47/023 292/201 |
| 2006/0284425 | A1* | 12/2006 | Torka | E05B 81/20 292/201 |
| 2008/0217928 | A1* | 9/2008 | Spurr | E05B 81/20 292/198 |

OTHER PUBLICATIONS

Written Opinion & international Search Report dated Sep. 12, 2013 in connection with international Application No. PCT/IB2013/053737.

* cited by examiner

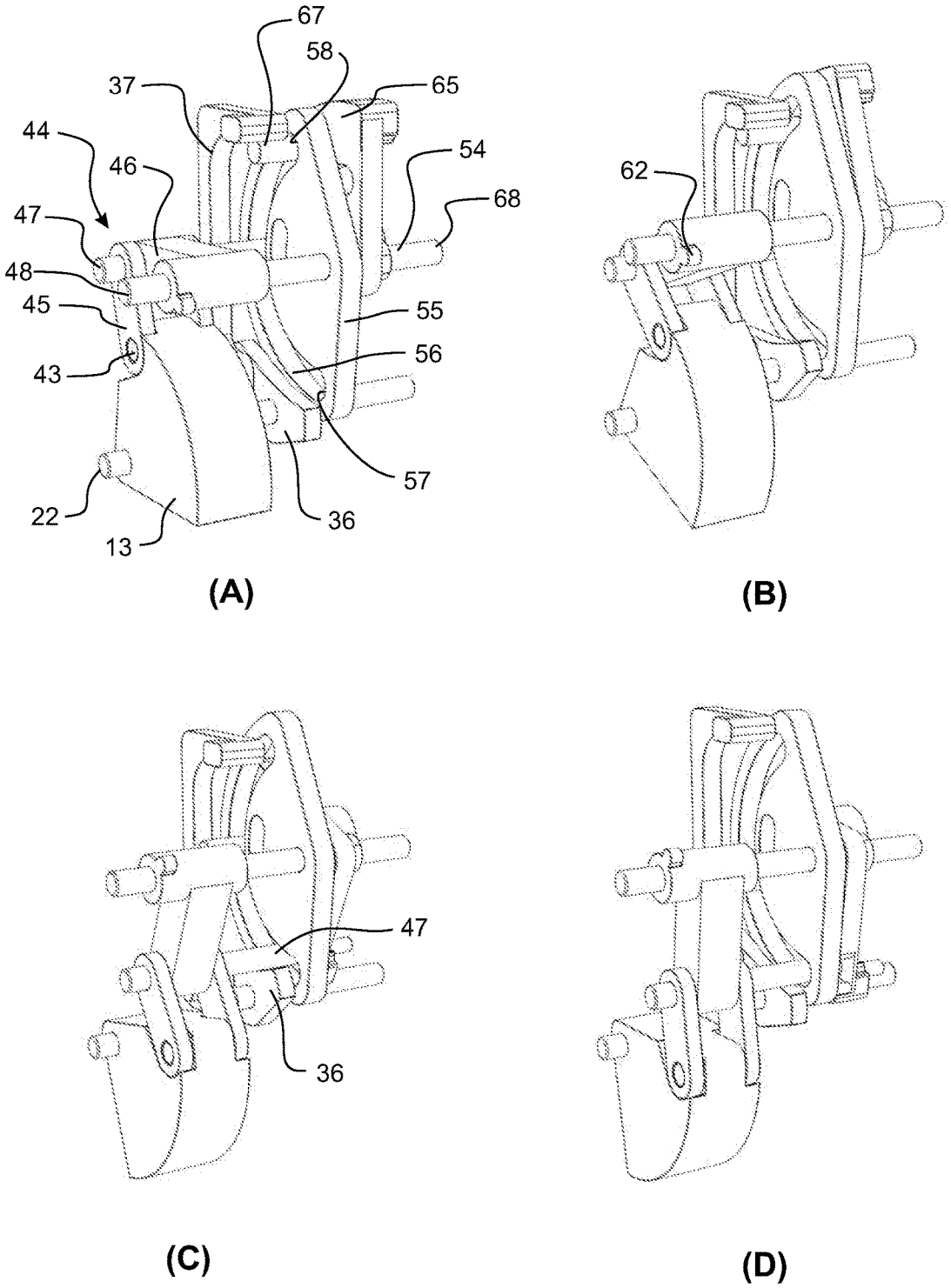
FIGURE 8(A-D)

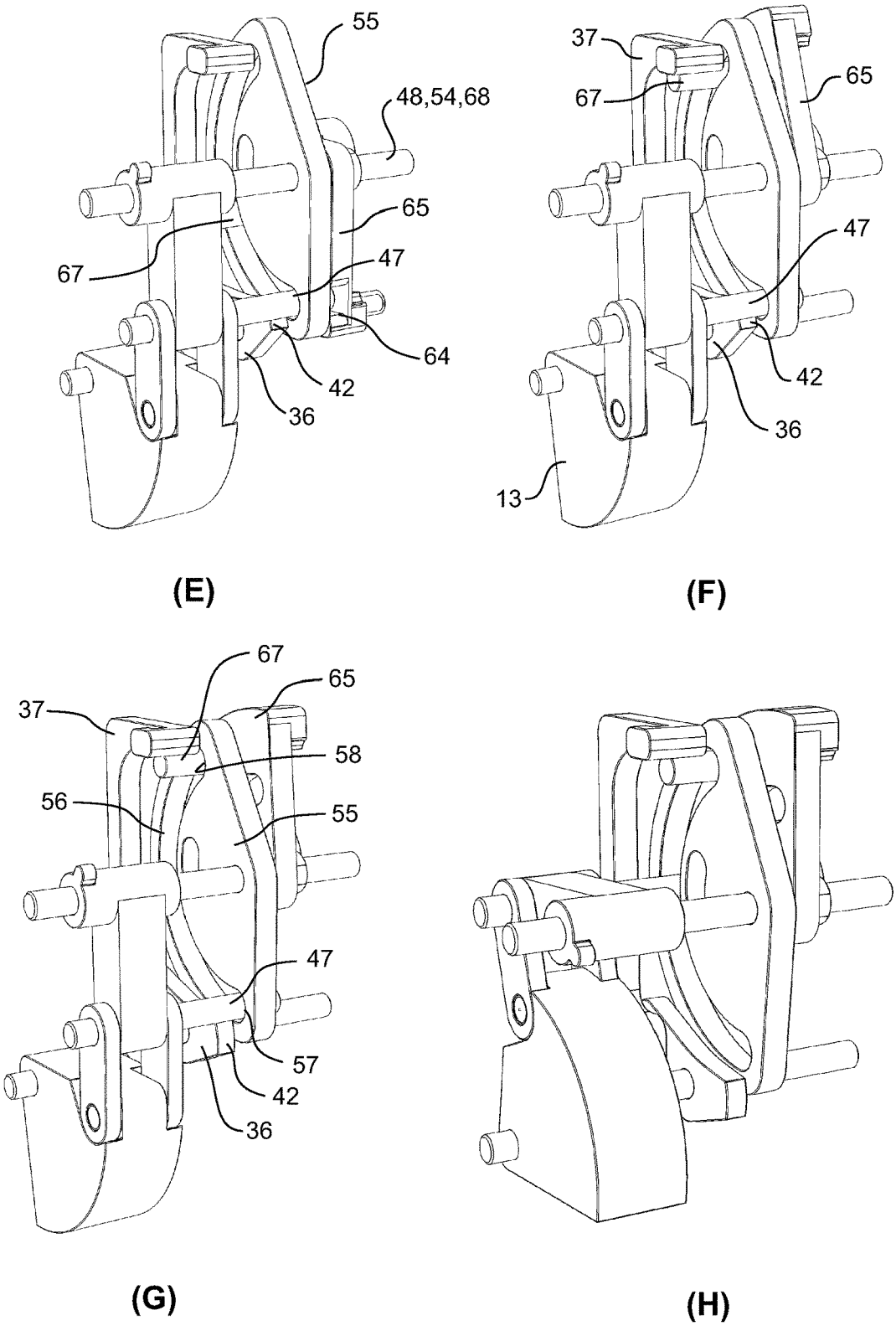
FIGURE 8(E-H)

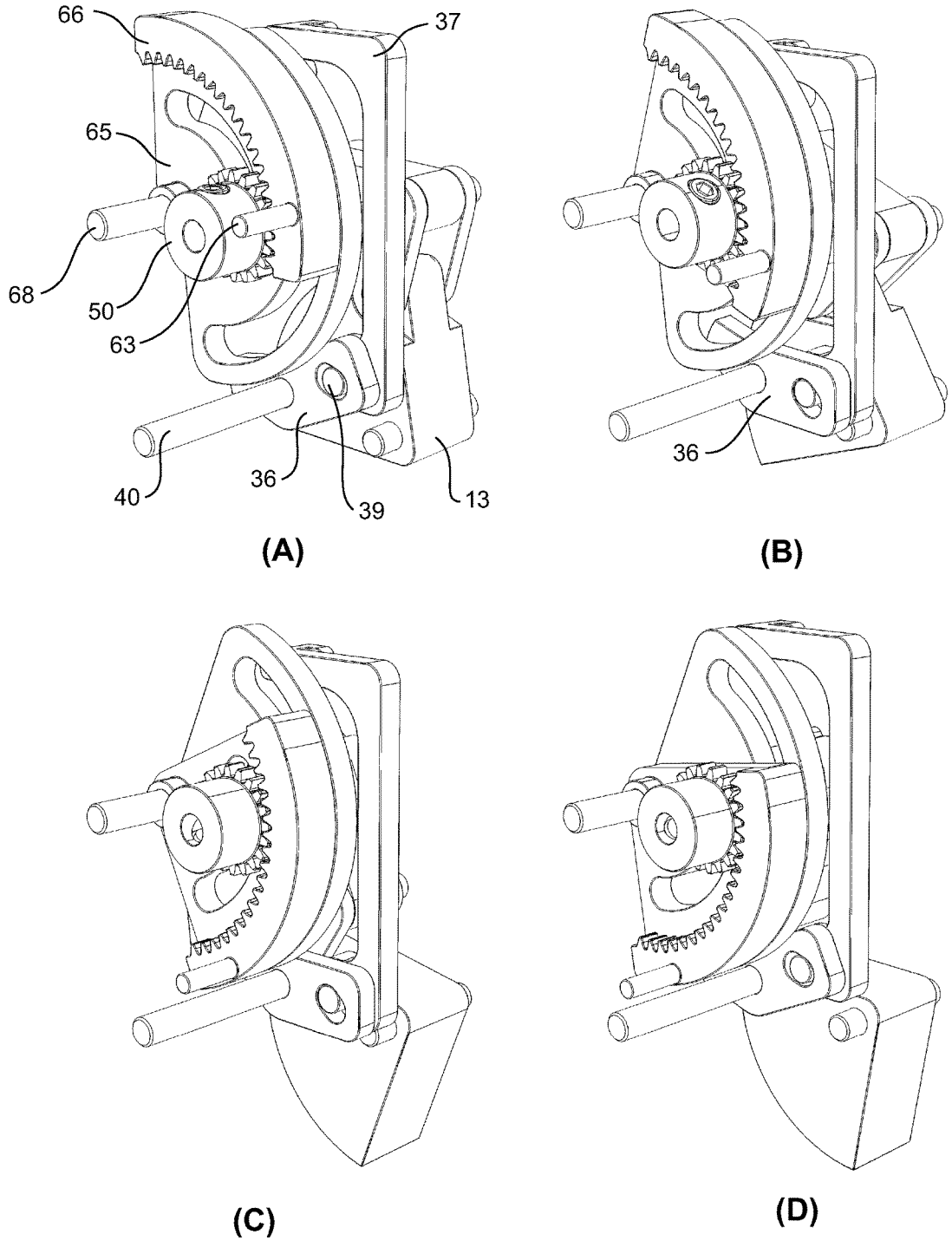
FIGURE 9(A-D)

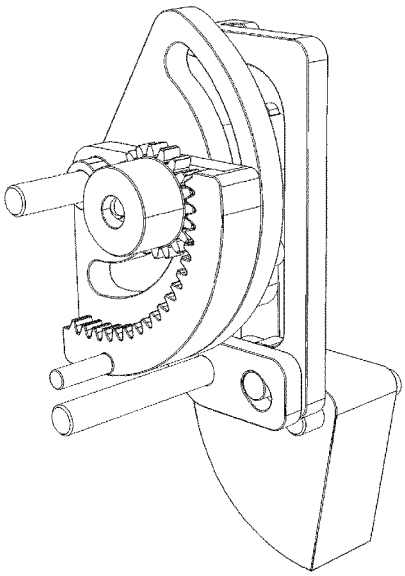
(E)
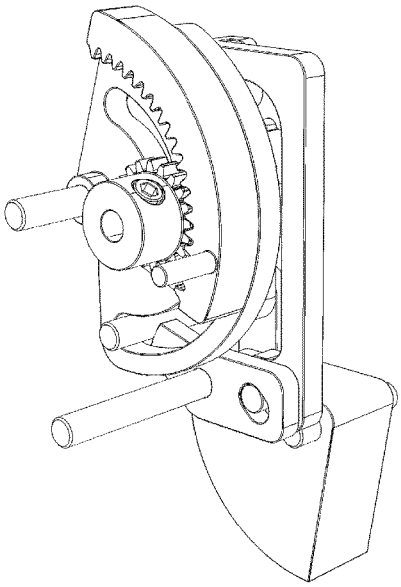
(F)
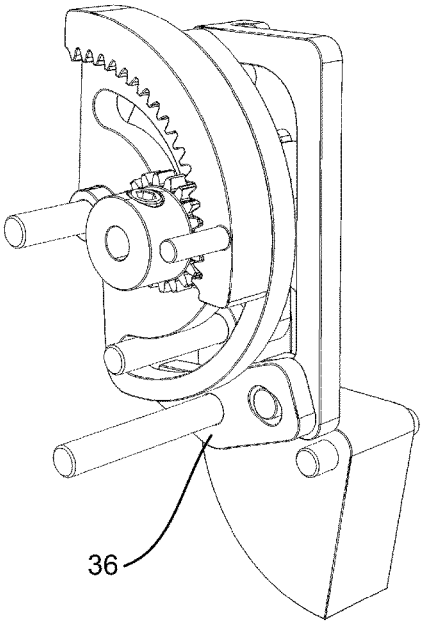
(G)
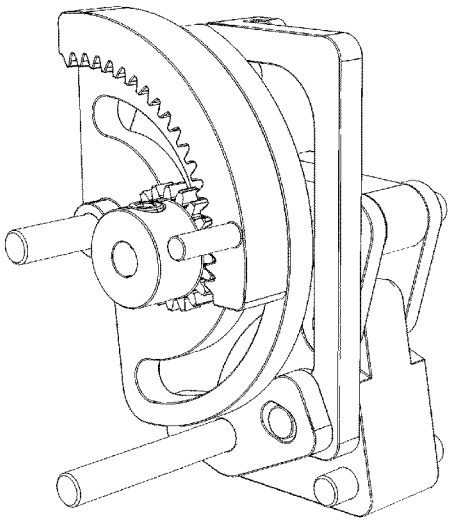
(H)
FIGURE 9(E-H)

LOCK

This application is a National Phase filing of PCT/IB2013/053737, having an International filing date of May 9, 2013, which claims priority to New Zealand Patent Application No. 599955, which was filed on May 11, 2012. The disclosures of the foregoing are hereby incorporated by reference.

FIELD OF THE INVENTION

The present invention relates to a lock for a door or other moveable member that moves between an open position and a closed position to open and close a pathway or opening, for example a window, a cupboard or a gate.

BACKGROUND TO THE INVENTION

Prior art locks for locking a door to a door frame comprises a pin or bolt that is movable between a retracted position to unlock the door from the door frame and an extended position to lock the door to the door frame.

In traditional locks, the pin of the lock is actuated between the retracted and extended positions by a key for turning a mechanism for moving the pin. Modern locks may comprise an actuator such as an electric motor for moving the pin between the retracted and extended positions. Such locks may be controlled remotely by a security system. When driving the pin from the extended position to the retracted position using an actuator such as a motor, the retraction rate of the pin is governed by the speed of the motor. The motor may move the pin at a relatively slow speed. Further, the actuator and mechanism for moving the pin must have sufficient power to move the pin from the extended position to the retracted position under onerous conditions, for example when a load is applied to a door that causes a force to be applied to the pin that the lock must overcome to retract the pin to unlock the door.

A lock that comprises an electrical actuator for driving the lock pin may be configured to a fail-open mode or a fail-close mode. In a fail-open mode, when the door is closed and locked and electrical power to the lock is cut, the lock automatically retracts the pin to unlock the door. Conversely, in a fail-close mode, when a door is closed unlocked and electrical power to the lock is cut, the lock automatically extends the pin to lock the door. A lock may be configurable to set the lock as a fail-close or fail-open lock. Configuration of such a lock may not be straight forward and may require multiple mechanical and electrical adjustments to be made.

When a door swings shut from an open position to a closed position, the pin must extend once the door is closed so that the pin aligns with an opening for receiving the pin to lock the door to a door frame. If the pin extends before the lock is sufficiently aligned with a lock strike plate, the pin can jam the door in an open position. Furthermore, a lock for locking a double swing door must be capable of locking a door when the door approaches a door frame from either of two directions.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an improved door lock or to at least provide the public with a useful choice.

SUMMARY OF THE INVENTION

In one aspect, the present invention consists in a lock for locking a door, the lock comprising:

- a pin moveable between a retracted position and an extended position for locking the door,
- an actuator movable from a first position to a second position to move the pin from the retracted position to the extended position,
- a mechanism comprising:
  - a spring for biasing the pin to the retracted position,
  - a latch, in a latched position the latch preventing the pin from moving from the extended position to the retracted position, and in an unlatched position the latch allowing the pin to move from the extended position to the retracted position, and
  - the mechanism adapted to disengage the actuator from the pin when the pin is in the extended position.

In some embodiments the lock comprises a controller, for a door locking operation the controller programmed to:

- drive the actuator from the first position to the second position to move the pin from the retracted position to the extended position,
- actuate the latch to the latched position,
- drive the actuator to disengage the actuator from the pin, the latch maintaining the pin in the extended position, and for a door unlocking operation the controller programmed to:

- actuate the latch to the unlatched position to allow the pin to move to the retracted position under action of the spring.

In some embodiments for a door locking operation the controller programmed to:

- drive the actuator in a forward direction from the first position to the second position to move the pin from the retracted position to the extended position,
- actuate the latch to the latched position,
- drive the actuator in a reverse direction from the second position to the first position or an intermediate position between the first and second positions thereby disengaging the actuator from the pin, the latch maintaining the pin in the extended position, and for a door unlocking operation the controller programmed to:
- actuate the latch to the unlatched position to allow the pin to move to the retracted position under action of the spring.

In some embodiments the actuator is a motor having a motor shaft for driving the pin from the retracted position to the extended position.

In some embodiments the actuator is a motor having a motor shaft for driving the pin from the retracted position to the extended position and the latch is adapted to be operated by the motor,

- for a door locking operation, the controller programmed to:
  - drive the motor in the forward direction from the first position to the second position to move the pin from the retracted position to the extended position and move the latch to the latched position,
  - drive the motor in the reverse direction from the second position to an intermediate position between the first and second positions, the latch maintaining the pin in the extended position, and for a door unlocking operation the controller programmed to:

drive the motor in the reverse direction from the intermediate position to the first position to move the latch to the unlatched position to allow the pin to move to the retracted position under action of the spring.

In some embodiments the intermediate position is adjacent the first position so that a relatively small motor movement is required to operate the latch to the unlatch position and move the pin to the retracted position.

In some embodiments the mechanism comprises a linkage coupled to the pin, the linkage comprising:

a first arm and a second arm rotationally coupled together by a linkage shaft, the first arm rotationally coupled to the pin via a first arm shaft, and the second arm rotationally supported in spaced relation from the pin by a second arm shaft, when the pin is in the retracted position, an angle between the first and second arms is an acute angle or the first arm shaft, the second arm shaft and the linkage shaft are substantially not aligned, and when the pin is in the extended position the linkage shaft, the first arm shaft and the second arm shaft are substantially aligned.

In some embodiments, when the pin is in the extended position the linkage shaft, the first arm shaft and the second arm shaft are substantially aligned on a line substantially parallel to a plane of the door when in the closed position.

In some embodiments the mechanism comprises a linkage coupled to the pin, the linkage comprising:

a first arm and a second arm rotationally coupled together by a linkage shaft, the first arm rotationally coupled to the pin via a first arm shaft, and the second arm rotationally supported in spaced relation from the pin by a second arm shaft, when the pin is in the retracted position, an angle between the first and second arms is an acute angle or the first arm shaft, the second arm shaft and the linkage shaft are substantially not aligned, and the linkage adapted so that when moving the pin from the retracted position to the extended position a centre of the linkage shaft passes through a line extending between the centre of the first arm shaft and a centre of the second arm shaft, in the extended position the angle between the first and second arms being greater than 180 degrees.

In some embodiments the centre of the linkage shaft passes through a line extending between the centre of the first arm shaft and a centre of the second arm shaft by a small distance, the angle between the first and second arms being less than approximately 181 degrees.

In some embodiments, for a door unlocking operation the controller being programmed to:

drive the motor in the reverse direction from the intermediate position to a third position between the intermediate position and the first position to move the latch to the unlatched position, and drive the motor in the reverse direction from the third position to the first position to move the linkage so that the centre of the linkage shaft passes through a line extending between the centre of the first arm shaft and a centre of the second arm shaft so that the pin moves to the retracted position under action of the spring.

In some embodiments the mechanism comprises a locking mechanism driven by the motor, the locking mechanism adapted to contact the linkage when the motor is driven in the forward direction to move the pin from the retracted position to the extended position.

In some embodiments the locking mechanism comprises a driven member driven by the motor, the driven member adapted to contact the linkage when the motor is driven in the forward direction to move the pin from the retracted position to the extended position.

In some embodiments the driven member is adapted to contact the linkage shaft, the driven member comprising a recess for receiving the linkage shaft, the recess open to a side so that the linkage shaft is released from the recess when the motor is driven in the reverse direction to disengage the motor from the pin.

In some embodiments the mechanism comprises an unlocking mechanism driven by the motor, the unlocking mechanism adapted to contact the linkage when the motor is in the third position so that movement of the motor from the third position to the first position moves the linkage so that the centre of the linkage shaft passes through a line extending between the centre of the first arm shaft and a centre of the second arm shaft so that the pin moves to the retracted position under action of the spring.

In some embodiments the unlocking mechanism is adapted to contact the linkage shaft.

In some embodiments the unlocking mechanism comprises;

an unlock member driven by the motor, an unlock cam for coupling the unlock member and the linkage when the motor is moved in the reverse direction to the third position.

In some embodiments the unlock member is a driven member driven by the motor, the driven member comprising a projection extending from the driven member and the unlock cam comprises a slot for receiving the projection, and when the motor is in the third position, the projection bears against a first end of the slot and the linkage bears against a second opposite end of the slot to couple the linkage to the motor via the unlock cam and the driven member.

In some embodiments the mechanism comprises a pinion fixed to a shaft of the motor, and the driven member comprises a rack engaged with the pinion.

In some embodiments the mechanism comprises a pair of spaced apart walls with the linkage located in between, each wall comprising a slot or groove for receiving the linkage shaft, ends of the slots or groove defining end stops for movement of the linkage.

In some embodiments, the mechanism comprises a second spring for biasing the latch to the latched position.

In some embodiments the latch comprises a latch arm for contacting the linkage to retain the pin in the extended position, the latch arm pivotally mounted on a latch shaft to move between the latched and unlatched positions.

In some embodiments the mechanism comprises a latch trigger driven by the motor for moving the latch between the latched and unlatched positions.

In some embodiments the latch comprises a link arm pivotally connected to the latch arm and the latch trigger is a driven member driven by the motor and having a projection, when the motor is in the third position, the projection contacts the link arm to move the latch arm to the unlatch position.

In some embodiments the lock comprises a first limit switch, a second limit switch and a third limit switch for communicating to the controller when the motor has reached the first position, the second position and the intermediate position.

In some embodiments the lock comprises a first limit switch, a second limit switch and a third limit switch for communicating to the controller when the motor has reached the first position, the second position and the intermediate position, and the driven member comprises a post for triggering each limit switch.

In some embodiments the lock comprises:

a fourth limit switch and a fifth limit switch, and an output, the fourth and fifth limit switches for communicating to the controller or the output when the pin has reached the retracted position and the extended position, the output for providing a signal to a system for controlling or monitoring the position of the pin being in the retracted or extended positions.

In some embodiments the lock comprises a motor current detection circuit for communicating to the controller an electrical current drawn by the motor, and in a door locking operation the controller programmed to:

a) monitor the electrical current drawn by the motor and compare the electrical current to a predetermined threshold, b) drive the motor in a forward direction to move the pin from the retracted position towards the extended position, c) if the electrical current increases above the threshold, drive the motor in a reverse direction, d) repeat steps a), b) and c) a predetermined number of times or until the pin reaches the extended position.

In some embodiments the pin pivots about an axis to move between the retracted and extended positions, the lock adapted and configured to be installed with the door or a door frame with the pin axis approximately parallel to a general plane of the door when in a closed position.

In some embodiments the lock is adapted and configured to be installed with the door or door frame with the pin axis approximately parallel with a door axis on which the door pivots between an open position and the closed position.

In some embodiments the lock is adapted for locking a double swing door that pivots about a door axis from a first open position to a closed position in a first direction of rotation and from a second open position to the closed position in a second direction of rotation, wherein the lock comprises:

a first said pin, a first said actuator, and a first said mechanism, the first pin for locking the door when closing from one of the first open position and the second open position, and a second said pin, a second said actuator, and a second said mechanism, the second pin for locking the door when closing from the other one of the first open position and the second open position.

In another aspect, the present invention consists in a lock for locking a door that pivots about a door axis between a closed position and an open position, the lock comprising a lock assembly for installation with the door or a door frame, the lock assembly comprising:

a pin supported by a pin shaft, the pin pivotable on the pin shaft about a pin axis between a retracted and an extended position, in the extended position the pin adapted to enter an opening in the other one of the door frame and the door to lock the door in the closed position, the lock assembly adapted and configured to be installed with the door or door frame with the pin axis approximately parallel to the door axis.

In some embodiments the lock assembly is adapted and configured to be installed with the door or door frame with the pin axis approximately parallel to a general plane of the door when in the closed position.

In some embodiments the lock assembly is adapted and configured so that the pin enters the opening when the door is adjacent to the closed position, rotation of the pin from the retracted position towards the extended position assisting rotation of the door towards the closed position by contact between the pin and an edge of the opening.

In some embodiments the pin is driven to pivot from the retracted position to the extended position in a first direction of rotation, the lock adapted for locking a door that moves in a second direction of rotation when moving from the open position to the closed position, the first direction of rotation being opposite to the second direction of rotation.

In some embodiments the lock comprises a strike plate for attachment to the other one of the door frame and the door, the strike plate comprising the opening for receiving the pin when the door is in the closed position.

In some embodiments the lock comprises:

a strike plate for attachment to the other one of the door frame and the door, the strike plate comprising the opening for receiving the pin in the extended position when the door is in the closed position, a trigger at or adjacent the strike plate, the lock assembly comprising a controller and a sensor for sensing the trigger to provide an output to the controller when the lock assembly is proximate to the strike plate, the controller controlling or actuating movement of the pin from the retracted position to the extended position when the controller receives said output.

In some embodiments the trigger comprises at least one of a magnet and a ferrous material.

In some embodiments the lock assembly comprises a motor for moving the pin from the retracted position to the extended position.

In some embodiments the lock assembly comprises:

an actuator movable from a first position to a second position to move the pin from the retracted position to the extended position, a mechanism comprising:

a spring for biasing the pin to the retracted position, a latch, in a latched position the latch preventing the pin from moving from the extended position to the retracted position, and in an unlatched position the latch allowing the pin to move from the extended position to the retracted position, and the mechanism adapted to disengage the actuator from the pin when the pin is in the extended position.

In some embodiments the lock comprises a controller, for a door locking operation the controller programmed to:

drive the actuator from the first position to the second position to move the pin from the retracted position to the extended position, actuate the latch to the latched position, drive the actuator to disengage the actuator from the pin, the latch maintaining the pin in the extended position, and for a door unlocking operation the controller programmed to:

actuate the latch to the unlatched position to allow the pin to move to the retracted position under action of the spring.

In some embodiments, the lock is adapted for locking a double swing door that pivots about a door axis from a first open position to a closed position in a first direction of rotation and from a second open position to the closed position in a second direction of rotation, wherein the lock comprises a lock assembly for installation with the door or a door frame, the lock assembly comprising:

a first pin movable between a retracted position and an extended position, in the extended position the first pin adapted to enter a first opening in the other one of the door and door frame to lock the door in the closed position when the door moves to the closed position from one of the first and second open positions, and a second pin movable between a retracted position and an extended position, in the extended position the second pin adapted to enter a second opening in the other one of the door or door frame to lock the door in the closed position when the door moves to the closed position from the other one of the first and second open positions.

In some embodiments the first pin pivots from the retracted position to the extended position about a first pin axis in a first direction of rotation for locking the door when the door moves to the closed position from one of the first and second open positions, and the second pin pivots from the retracted position to the extended position about a second pin axis in an opposite second direction of rotation for locking the door when the door moves to the closed position from the other one of the first and second open positions.

In some embodiments, the lock assembly is adapted and configured to be installed with the door or door frame with the first pin axis and the second pin axis parallel to a general plane of the door when in the closed position.

In some embodiments the lock is adapted and configured so that:

the first pin enters the first opening when the door is adjacent to the closed position when the door moves towards the closed position from one of the first and second open positions, rotation of the first pin towards the extended position assisting rotation of the door to the closed position by contact between the pin and an edge of the first opening, and the second pin enters the second opening when the door is adjacent to the closed position when the door moves towards the closed position from the other one of the first and second open positions, rotation of the second pin towards the extended position assisting rotation of the door to the closed position by contact between the pin and an edge of the second opening In some embodiments, the lock assembly is adapted and configured to be installed with the door or door frame with the first pin axis and the second pin axis approximately parallel to the door axis.

In some embodiments the first pin pivots from the retracted position to the extended position in the first direction of rotation for locking the door when moving in the second direction of rotation from the second open position to the closed position, and the second pin pivots from the retracted position to the extended position in the second direction of rotation for locking the door when moving in the first direction of rotation from the first open position to the closed position.

In some embodiments the lock comprises:

a strike plate for attachment to the other one of the door frame and the door, the strike plate having a first opening for receiving the first pin in the extended position when the door is in the closed position, and a second opening for receiving the second pin in the extended position when the door is in the closed position, a first trigger at or adjacent the strike plate and a second trigger at or adjacent the strike plate, the lock assembly comprising:

a controller, a first sensor for sensing the first trigger to provide a first output to the controller when the lock assembly is proximate to the strike plate, the controller controlling or actuating movement of the first pin from the retracted position to the extended position when the controller receives said first output, and a second sensor for sensing the second trigger to provide a second output to the controller when the lock assembly is proximate to the strike plate, the controller actuating the second pin from the retracted position to the extended position when the controller receives said second output, the first and second triggers or the first and second sensors being positioned so that:

when the door moves from the first open position to the closed position in the first direction of rotation the controller actuates movement of the second pin from the retracted position to the extended position before the controller actuates movement of the first pin from the retracted position to the extended position, and when the door moves from the second open position to the closed position in the second direction of rotation the controller actuates movement of the first pin from the retracted position to the extended position before the controller actuates movement of the second pin from the retracted position to the extended position.

In some embodiments the first and second triggers or the first and second sensors are offset relative to one another and a centre of the closed position of the door.

In some embodiments the first and second triggers or the first and second sensors are offset to opposite sides of a centre of the closed position of the door.

In some embodiments the first and second triggers each comprise at least one of a magnet and a ferrous material.

In some embodiments the first and second openings are a single opening, the first opening being a first region of the single opening for receiving the first pin, and the second opening being a second region of the single opening for receiving the second pin.

In some embodiments the lock assembly comprises:

a first motor for moving the first pin from the retracted position to the extended position, and a second motor for moving the second pin from the retracted position to the extended position.

In some embodiments the lock assembly comprises:

an actuator movable from a first position to a second position to move the pin to the extended position, and a mechanism comprising:

a latch, in a latched position the latch preventing the pin from moving from the extended position to the retracted position, and in an unlatched position the latch allowing the pin to move from the extended position to the retracted position, and a linkage for supporting the pin so that a force acting on a locking surface of the pin when the pin is in the extended position is substantially transferred to the pin shaft and through said linkage to a linkage support, and the force is substantially not transferred to other components of the mechanism.

In some embodiments the linkage is coupled to the pin, the linkage comprising:

a first arm and a second arm rotationally coupled together by a linkage shaft, the first arm rotationally coupled to the pin via a first arm shaft, and the second arm rotationally supported in spaced relation from the pin by a second arm shaft, when the pin is in the retracted position, an angle between the first and second arms is an acute angle or the first arm shaft, the second arm shaft and the linkage shaft are substantially not aligned, and when the pin is in the extended position the linkage shaft, the first arm shaft and the second arm shaft are substantially aligned.

In some embodiments when the pin is in the extended position the linkage shaft, the first arm shaft and the second arm shaft are substantially aligned on a line substantially parallel to a plane of the door when in the closed position.

In some embodiments the linkage is coupled to the pin, the linkage comprising:

a first arm and a second arm rotationally coupled together by a linkage shaft, the first arm rotationally coupled to the pin via a first arm shaft, and the second arm rotationally supported in spaced relation from the pin by a second arm shaft, when the pin is in the retracted position, an angle between the first and second arms is an acute angle, and the linkage adapted so that when moving the pin from the retracted position to the extended position a centre of the linkage shaft passes through a line extending between the centre of the first arm shaft and a centre of the second arm shaft, in the extended position the angle between the first and second arms being greater than 180 degrees.

In some embodiments the centre of the linkage shaft passes through a line extending between the centre of the first arm shaft and a centre of the second arm shaft by a small distance, the angle between the first and second arms being less than approximately 181 degrees.

In another aspect, the present invention consists in a lock for locking a double swing door that pivots about a door axis from a first open position to a closed position in a first direction of rotation and from a second open position to the closed position in a second direction of rotation, wherein the lock comprises a lock assembly for installation with the door or a door frame, the lock assembly comprising:

a first pin movable between a retracted position and an extended position, in the extended position the first pin adapted to enter a first opening in the other one of the door and door frame to lock the door in the closed position when the door moves to the closed position from one of the first and second open positions, and a second pin movable between a retracted position and an extended position, in the extended position the second pin adapted to enter a second opening in the other one of the door or door frame to lock the door in the closed position when the door moves to the closed position from the other one of the first and second open positions.

In some embodiments the lock comprises a strike plate for attachment to the other one of the door frame and the door, the strike plate comprising the first opening for receiving the first pin when the door is in the closed position and the second opening for receiving the second pin when the door is in the closed position.

In some embodiments the first and second pins or the first and second openings are adapted so that with the door in the closed position and the first and second pins in their extended positions, one of said first and second pins contacts an edge of the corresponding first or second opening, and the other one of the first and second pins does not contact an edge of the corresponding first or second openings.

In some embodiments an edge of the first opening is adapted to contact a locking surface of the first pin, and an edge of the second opening is adapted to contact a locking surface of the second pin, and the edge of the first opening and the edge of the second opening are offset to opposites sides of a centre of the closed position of the door.

In some embodiments the locking surface of the first pin and the locking surface of the second pin are offset to opposites sides of a centre of the closed position of the door.

In some embodiments the first pin pivots from the retracted position to the extended position about a first pin axis in the first direction of rotation for locking the door when the door moves to the closed position from one of the first and second open positions, and the second pin pivots from the retracted position to the extended position about a second pin axis in an opposite second direction of rotation for locking the door when the door moves to the closed position from the other one of the first and second open positions.

In some embodiments, the lock assembly is adapted and configured to be installed with the door or door frame with the first pin axis and the second pin axis parallel to a general plane of the door when in the closed position.

In some embodiments, the lock is adapted and configured so that:

the first pin enters the first opening when the door is adjacent to the closed position when the door moves towards the closed position from one of the first and second open positions, rotation of the first pin towards the extended position assisting rotation of the door to the closed position by contact between the pin and an edge of the first opening, and the second pin enters the second opening when the door is adjacent to the closed position when the door moves towards the closed position from the other one of the first and second open positions, rotation of the second pin towards the extended position assisting rotation of the door to the closed position by contact between the pin and an edge of the second opening In some embodiments, the lock assembly is adapted and configured to be installed with the door or door frame with the first pin axis and the second pin axis approximately parallel to the door axis.

In some embodiments the first pin pivots from the retracted position to the extended position in the first direction of rotation for locking the door when moving in the second direction of rotation from the second open position to the closed position, and the second pin pivots from the retracted position to the extended position in the second direction of rotation for locking the door when moving in the first direction of rotation from the first open position to the closed position.

In some embodiments the lock comprises:

a first mechanism for moving the first pin between the retracted and extended positions, and a second mechanism for moving the second pin between the retracted and extended positions In some embodiments the lock assembly comprises a first motor to drive the first mechanism to move the first pin from the retracted position to the extended position, and a second motor to drive the second mechanism to move the second pin from the retracted position to the extended position.

In some embodiments the lock comprises:

a strike plate for attachment to the other one of the door frame and the door, the strike plate having a first opening for receiving the first pin in the extended position when the door is in the closed position, and a second opening for receiving the second pin in the extended position when the door is in the closed position, a first trigger at or adjacent the strike plate and a second trigger at or adjacent the strike plate, the lock assembly comprising:

a controller, a first sensor for sensing the first trigger to provide a first output to the controller when the lock assembly is proximate to the strike plate, the controller controlling or actuating movement of the first pin from the retracted position to the extended position when the controller receives said first output, and a second sensor for sensing the second trigger to provide a second output to the controller when the lock assembly is proximate to the strike plate, the controller actuating the second pin from the retracted position to the extended position when the controller receives said second output, the first and second triggers or the first and second sensors being positioned so that:

when the door moves from the first open position to the closed position in the first direction of rotation the controller actuates movement of the second pin from the retracted position to the extended position before the controller actuates movement of the first pin from the retracted position to the extended position, and when the door moves from the second open position to the closed position in the second direction of rotation the controller actuates movement of the first pin from the retracted position to the extended position before the controller actuates movement of the second pin from the retracted position to the extended position.

In some embodiments the first and second triggers or the first and second sensors are offset relative to one another and a centre of the closed position of the door.

In some embodiments the first and second triggers or the first and second sensors are offset to opposite sides of a centre of the closed position of the door.

In some embodiments the first and second triggers each comprise at least one of a magnet and a ferrous material.

In some embodiments the first and second sensors are Hall sensors.

In some embodiments the first and second openings are a single opening, the first opening being a first region of the single opening for receiving the first pin, and the second opening being a second region of the single opening for receiving the second pin.

In some embodiments the lock comprises a strike plate for attachment to the other one of the door frame and the door, the strike plate comprising the first opening for receiving the first pin when the door is in the closed position, the second opening for receiving the second pin when the door is in the closed position, a first roller positioned at the first opening, and a second roller positioned at the second opening, and the first and second pins each comprising a curved back surface.

In some embodiments in use the curved back surface of the first pin contacts the first roller when the second pin is moved from the extended position towards the retracted position and the door is moved from the closed position to move the back curved side of the first pin against the first roller before the first pin has moved to the retracted position and the first roller rotates in contact with the first pin to allow the first pin to move to the retracted position, and the curved back surface of the second pin contacts the second roller when the first pin is moved from the extended position towards the retracted position and the door is moved from the closed position to move the back curved side of the second pin against the second roller before the second pin has moved to the retracted position and the second roller rotates in contact with the second pin to allow the second pin to move to the retracted position.

In another aspect, the present invention consists in a lock for a door comprising a pin moveable between a retracted position and an extended position for locking the door in a closed position, the lock comprising:

a mechanism for moving the pin between the retracted position and the extended position, a controller for controlling the mechanism to move the pin between the retracted and extended positions, a backup power supply for storing an electrical charge, a power input for providing electrical power for actuating the mechanism to move the pin between the retracted and extended positions, a user configurable device for selecting one of a fail-open mode and a fail-closed mode, in the fail-open mode, when the pin is in the extended position and the door is in the closed position and the controller detects no electrical power, the controller releases the electrical charge to actuate the mechanism to move the pin from the extended position to the retracted position, and in the fail-closed mode, when the pin is in the retracted position and the door is in the closed position and the controller detects no electrical power, the controller releases the electrical charge to actuate the mechanism to move the pin from the retracted position to the extended position.

In some embodiments the backup power supply comprises a capacitor.

In some embodiments the device is a jumper on a circuit board or a switch moveable between two positions, selection of one of the fail-open and the fail-closed modes communicated to the controller by the position of the jumper or the switch.

In some embodiments the lock comprises a motor, the motor energisable by the electrical power or the electrical charge to actuate the mechanism to move the pin from the retracted position to the extended position.

In some embodiments the lock comprises a motor, the motor energisable by the electrical power or the electrical charge to actuate the mechanism to move the pin from the extended position to the retracted position.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

As used herein the term "and/or" means "and" or "or", or both.

As used herein "(s)" following a noun means the plural and/or singular forms of the noun.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples only.

BRIEF DESCRIPTION OF THE DRAWINGS

Preferred embodiments of the invention will be described by way of example only and with reference to the drawings, in which:

FIG. 8 illustrates a locking and unlocking sequence of a mechanism of the lock of FIGS. 1 and 3, with some components of the lock mechanism omitted for clarity.

FIG. 9 illustrates the same locking and unlocking sequence as FIG. 8, but illustrating the mechanism from a different perspective.

DETAILED DESCRIPTION OF PREFERRED EMBODIMENTS

Figure 1:
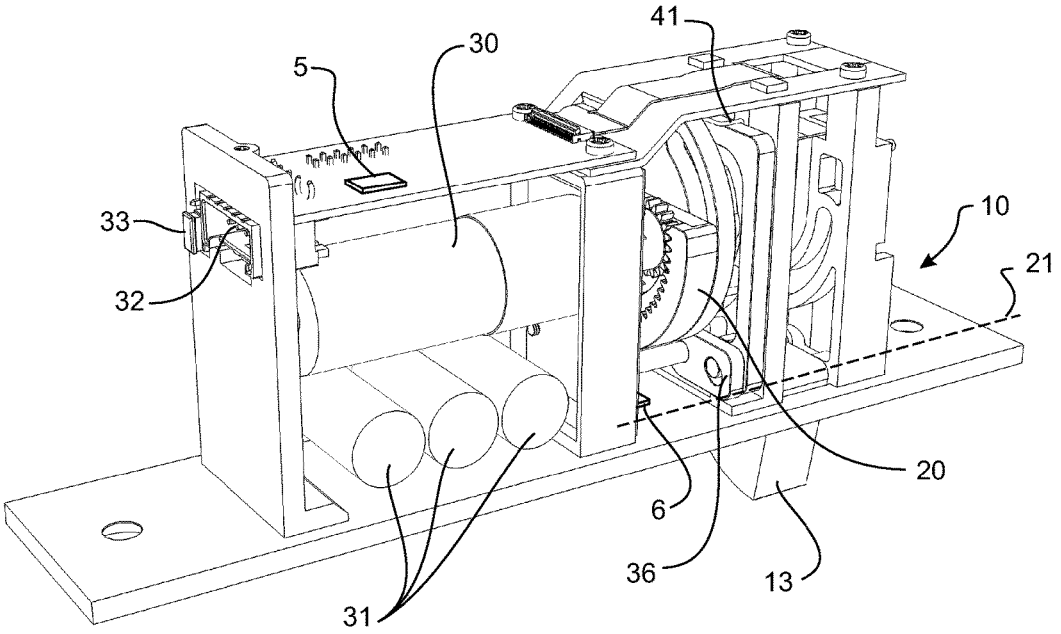
FIG. 1 is a perspective view of a lock according to one embodiment of the present invention comprising a single pin for locking a door.
Figure 2:
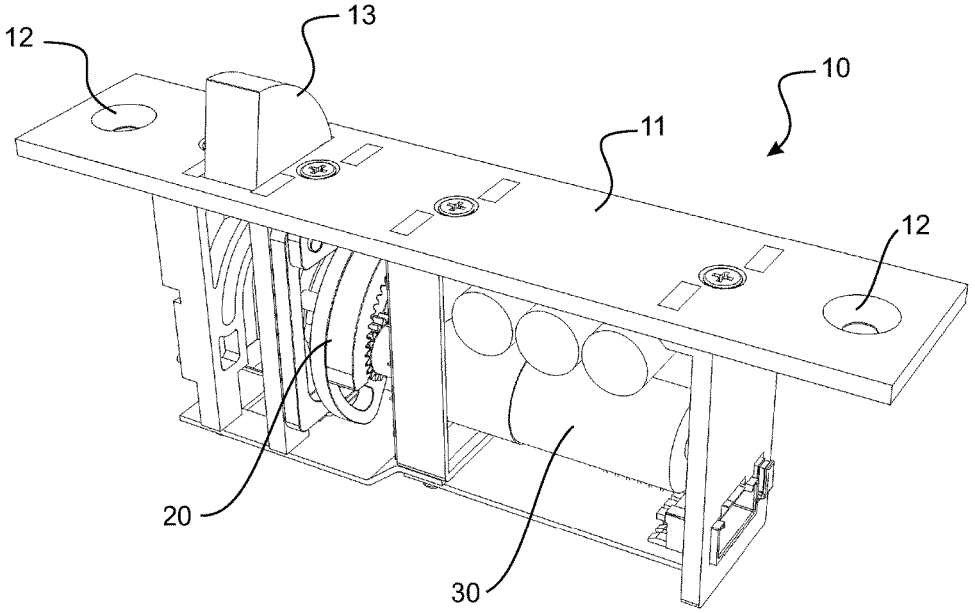
FIG. 2 is another perspective view of the lock of FIG. 1.
Figure 5:
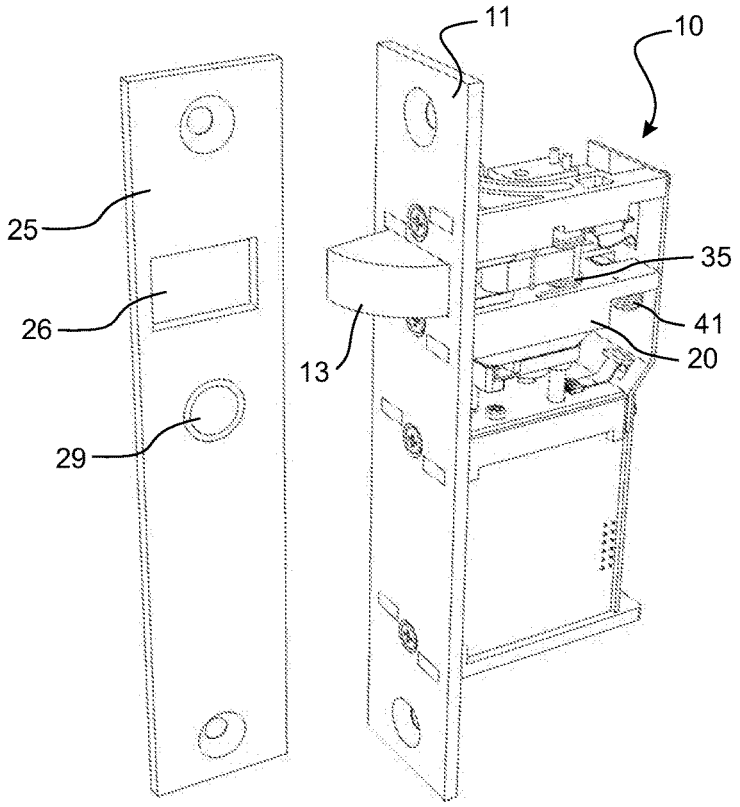
FIG. 5 is another perspective view of the lock of FIG. 1 including a strike plate.

A lock for locking a door to a door frame according to one embodiment of the present invention is illustrated in FIGS. 1, 2 and 5. The lock comprises a lock assembly 10. Preferably the lock assembly is adapted for installation with a door or door frame. The door is moveable between a closed position and an open position. Preferably the lock assembly is adapted to be installed at an edge of a door or door frame. Thus a width of the lock assembly is preferably less than a thickness of a door in which the assembly is to be installed. When installed in a door, a front plate or surface 11 of the lock assembly is positioned at the edge of the door and preferably flush with the edge of the door. When installed in a door frame, the front plate or surface 11 of the lock assembly is preferably flush with a surface of the door frame facing the edge of the door. The lock assembly preferably has fastening holes 12 located in the front plate for securing the lock assembly to a door or door frame with fasteners.

The lock assembly comprises a pin 13 moveable between a retracted position and an extended position. FIGS. 1, 2 and 5 illustrate the pin in the extended position. In the extended position the pin locks the door to a door frame when the door is in the closed position with the edge of the door adjacent the door frame. With the lock assembly fitted to one of a door and a door frame, in the extended position, a locking surface of the pin makes contact with a strike plate fitted to the other one of the door or door frame. In the retracted position, the door is unlocked from the door frame allowing the door to be moved open. In the retracted position the pin is retracted to the retracted position so that the locking surface is clear of the strike plate.

Figure 7:
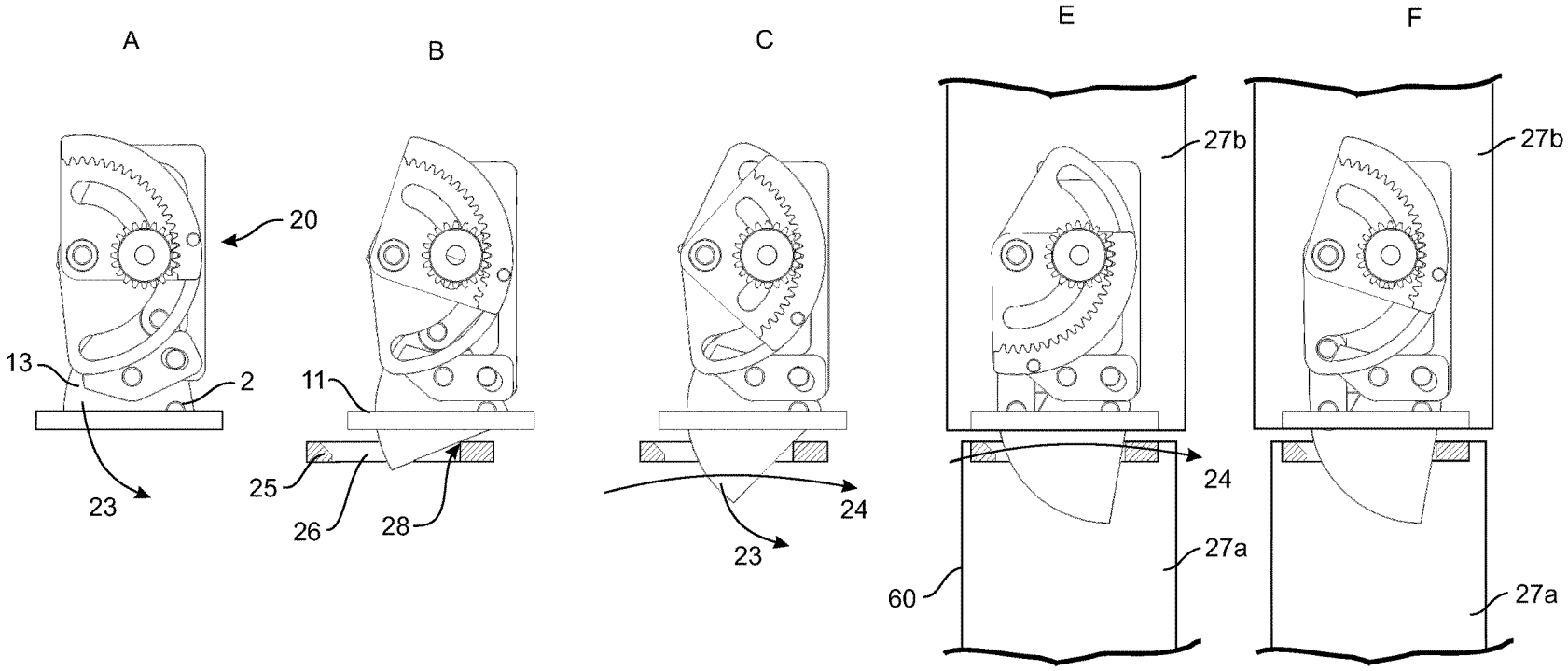
FIG. 7 illustrates a locking sequence, a door pin of the lock of FIG. 1 or 3 moving from a retracted position in FIG. 7A to an extended position in Figure F (note, FIG. 7 includes views A-C, E and F corresponding with views A-C, E and F of FIGS. 8 and 9, a view D is omitted from FIG. 7).

The lock assembly comprises a mechanism 20 for pivoting the pin 13 between the retracted and extended positions about an axis (the axis illustrated by a dashed line 21 in FIG. 1). The pin pivots on a pin shaft 22 best shown in FIG. 7. With reference to FIG. 7, the lock assembly is adapted to be installed with a door frame or door so that the pin axis 21 is approximately parallel to a door axis on which the door pivots between an open position and a closed position. For example, the pin shaft axis and the axis of a door hinge on which a door pivots are substantially vertical. By example, FIG. 7 illustrates the lock assembly installed in a door frame 27*b* for locking a door 27*a*. The pin has a locking surface for interfacing or contacting a strike plate. The locking surface may be described as the leading side of the pin as the pin moves towards the extended position. An opposite or trailing side of the pin is curved or arcuate in shape. For example, the curvature of the trailing side of the pin has a centre of curvature at the pin shaft 22.

Preferably the lock assembly is adapted to be installed with a door or door frame so that the pin 13 pivots from the retracted position to the extended position in a first direction of rotation indicated by arrow 23 in FIG. 7. The lock is adapted for locking a door that moves in a second direction of rotation when moving from the open position to the closed position, the first direction of rotation being opposite to the second direction of rotation. The second direction of rotation is indicted by arrow 24 in FIG. 7.

The lock comprises a strike plate 25 for attachment to the other one of the door frame and door. By example, FIG. 7 illustrates the strike plate attached to the door 27*a*. The strike plate has an opening 26 for receiving the pin 13 in the extended position when the door is in the closed position. FIG. 7 provides a sequence illustrating the pin 13 at different positions moving in the first direction of rotation 23 from the retracted position (indicated by FIG. 7A) to the extended position (FIGS. 7E and 7F). The door 27*a* is shown in the closed position in FIGS. 7E and 7F.

The pin 13 and the opening of the strike plate 26 are adapted so that the pin 13 enters the opening 26 when the door 27*a* is adjacent to the closed position, for example as shown in FIG. 7B. As the pin enters the strike plate opening before the door has reached the closed position, movement of the pin in the first direction of rotation towards the extended position assists movement of the door in the second direction of rotation towards the closed position. As illustrated in FIGS. 7B and 7C, contact between the locking surface of the pin and an edge 28 of the opening in the strike plate causes the door to be 'pushed' in the closed direction 24 as the pin rotates in the first direction 23.

In a lock according to the present invention, in one possible installation, because the pin rotates about an axis approximately parallel to the door axis, and the direction of rotation of the pin is opposite to the direction of rotation of the door, the pin can enter the strike plate opening before the door reaches the closed position and movement of the pin towards the extended position assists to close the door.

In the above example installation, the lock assembly is installed with the door or door frame so that the lock pin pivot axis is parallel to the door axis. For example, for a door that pivots about a vertical axis, the lock assembly is installed in a vertical edge of the door or vertical side of the door frame with the pin axis arranged vertically. In an alternative installation, the lock may be installed with the pin axis perpendicular to the door axis. For example, for a door that pivots about a vertical axis, the lock assembly may be installed in the top edge of a door or the top of a door frame with the pin axis arranged horizontally. In both example installations, the lock assembly is positioned so that the pin axis is parallel to a general plane of the door when the door is in the closed position. With the pin axis parallel to a general plane of the door when the door is in the closed position, the pin may be pivoted about the pin axis to enter the opening in the strike plate in a direction to assist the door in the closing direction of movement. Therefore, a lock according to the present invention is adapted to be installed with the door or door frame so that when the pin moves from the retracted position to the extended position, the pin can enter the opening in the strike plate in a direction to assist the door in the closing direction of movement.

Preferably the lock assembly comprises a controller for controlling the mechanism to move the pin between the retracted and extended positions. Preferably the controller 5 (FIG. 1) is a microprocessor located on a circuit board incorporated in the lock assembly.

Preferably the strike plate comprises a trigger element 29 (illustrated in FIG. 5) and the lock assembly comprises a sensor 6 (FIG. 1) for sensing the trigger element. The sensor provides an output to the controller when the sensor is near to the trigger which occurs when the lock assembly is proximate to the strike plate. Once the controller receives the sensor output, the controller actuates the mechanism to move the pin from the retracted position to the extended position to lock the door to the door frame. Alternatively the lock may be provided with a user interface, for example a push button, for allowing the user to actuate the lock to move the pin to the extended position or to the retracted position.

In one embodiment the trigger is a magnet and the sensor is a reed switch or Hall sensor. Alternatively, the trigger is a ferrous metal. Alternatively the trigger is an optical element and the sensor is an optical sensor. For example the trigger is a reflector. Preferably the sensor is analogue, not digital, so that the sensor is capable of sensing signal strength. As the door gets closer to the closed position, the analogue signal strength increases. The controller actuates the mechanism to move the pin from the retracted position to the extended position once the signal strength is greater than a predetermined threshold.

Preferably the lock assembly comprises a rotational motor 30 for driving the pin 13 from the retracted position to the extended position via the mechanism. Alternatively the lock assembly comprises a linear motor or actuator for driving the pin from the retracted position to the extended position via the mechanism.

Preferably the lock comprises a backup power supply 31 for storing an electrical charge, and a user configurable device for selecting one of a fail-open mode and a fail-closed mode. Preferably the backup power supply comprises a capacitor for storing the electrical charge. The lock assembly is provided with an electrical power input, for example an electrical connector 32, for providing electrical power to the lock. The controller controls energisation of the motor by the electrical power supply. The connector 32 preferably also provides an input/output electrical connection for providing control signals to and from the lock. For example, the connector provides a control input for allowing a user to provide a signal to the controller to unlock the lock.

In the fail-open mode, when the pin is in the extended position and the controller detects no electrical power (via for example an electrical power detection circuit), the controller releases the electrical charge stored by the backup power supply to energise the motor or other actuator to move the pin from the extended position to the retracted position. Therefore, in the fail open mode, where there is a power cut to the lock assembly, the lock assembly automatically unlocks the door. In the fail open mode with the pin in the retracted position, the lock maintains the pin in the retracted position when there is a power cut.

In the fail-closed mode, when the pin is in the retracted position and the controller detects no electrical power, and the sensor senses the trigger, the controller releases the electrical charge from the backup power supply to energise the motor or other actuator to move the pin from the retracted position to the extended position. Therefore, in the fail close mode, where there is a power cut to the lock assembly, the lock assembly automatically locks the door. In the fail-closed mode with the pin in the extended position, the controller maintains the position of the pin at the extended position when there is a power cut.

The lock may comprises a plurality of capacitors 31 which in combination provide an electrical charge sufficient for energising the motor. Alternatively, the backup power supply comprises a battery. The battery may be rechargeable by electrical power provided to the lock via the power input.

Preferably the user configurable device is a jumper 33 on a circuit board moveable between two positions. Selection of one of the fail-open and the fail-closed modes is communicated to the controller by the position of the jumper on the circuit board. This arrangement makes the lock easily configurable by a user, even a relatively unskilled user or lock installer. Alternatively, the configurable device is a switch.

A lock assembly according to another preferred embodiment of the present invention is a shown in FIG. 3, FIG. 4 and FIGS. 6*a* and 6*b*. The lock assembly 110 may be adapted for locking a double swing door. A double swing door is a door that pivots or swings through the door frame and can approach the door frame from both sides. The door pivots about the door axis from a first open position to the closed position in a first direction of rotation and from a second open position to the closed position in a second direction of rotation.

Figure 3:
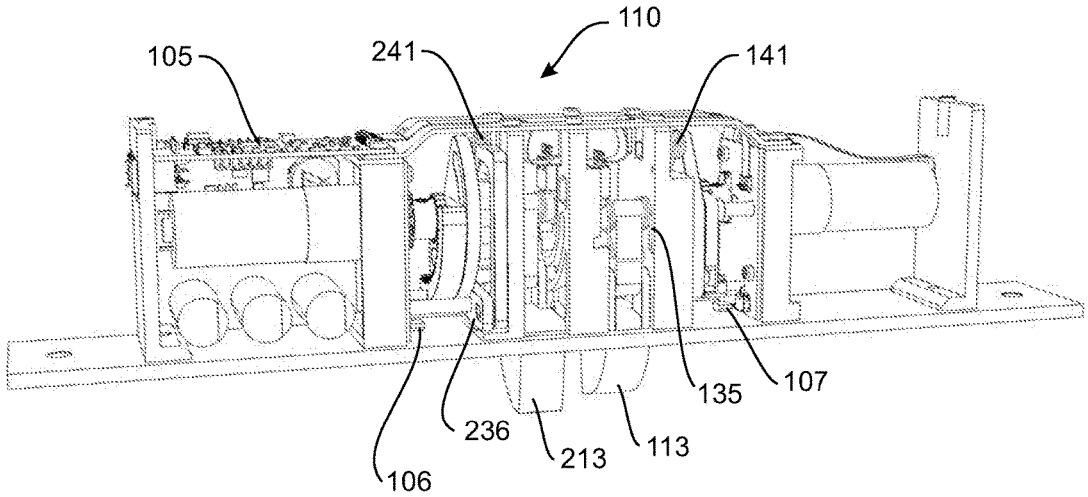
FIG. 3 is a perspective view of a lock according to another embodiment of the present invention comprising two pins for locking a door, preferably a double swing door.
Figure 4:
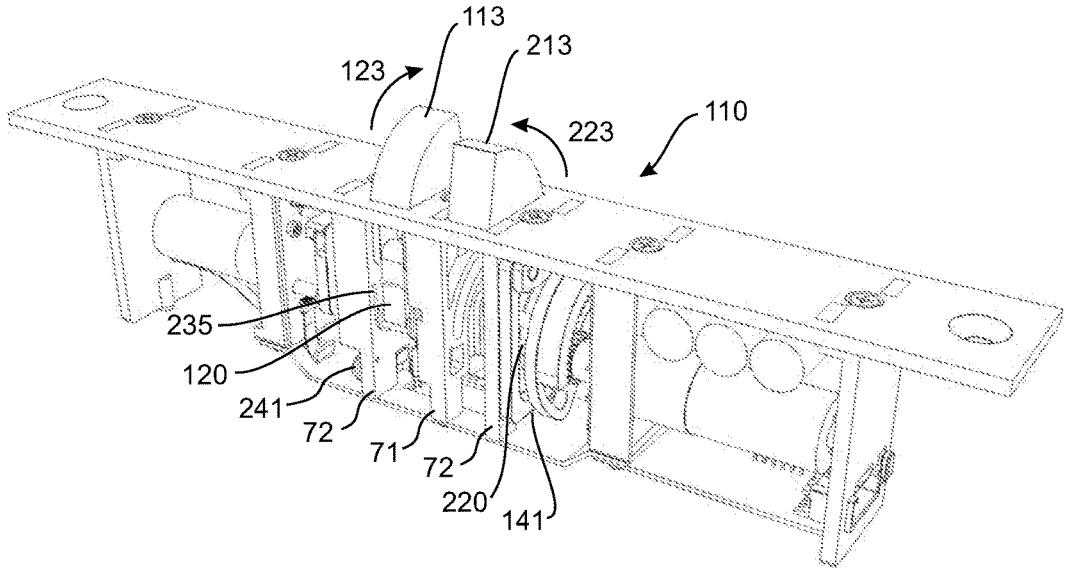
FIG. 4 is another perspective view of the lock of FIG. 3.

The lock assembly of FIGS. 3, 4 and 6 comprise two said pins 113 and 213 and two corresponding mechanisms for moving the pins 113, 213 between the retracted and extended positions. A first mechanism 120 pivots a first pin 113 from the retracted position to the extended position. The first pin pivots in a first direction of rotation 123 when moving from the retracted position to the extended position. The first pin pivots about a first axis approximately parallel to the door axis for locking the door when the door moves in the second direction of rotation 223 pivoting about an axis or door hinge from the second open position to the closed position.

A second said mechanism 220 pivots a second pin 213 from the retracted position to the extended position. The second pin pivots in the second direction of rotation 223 when moving from the retracted position to the extended position. The second pin pivots about a second axis approximately parallel to the door axis for locking the door when the door moves in the first direction of rotation 123 pivoting about an axis or door hinge from the first open position to the closed position.

The lock comprising lock assembly 110 may comprise a strike plate 125 as described with reference to the single pin lock embodiment. The strike plate has a first opening 126 for receiving the first pin 113 when the door is in the closed position. The first pin and the first opening of the strike plate are adapted so that the first pin enters the first opening when the door is adjacent to the closed position and moving from the second open position. As the first pin enters the first opening before the door has reached the closed position, movement of the first pin in the first direction of rotation towards the extended position assists movement of the door in the second direction of rotation towards the closed position. Contact between the first pin and an edge of the first opening in the strike plate causes the door to be 'pushed' in the second direction of rotation as the pin rotates in the first direction. In the illustrated embodiment the first opening and the second opening are separate openings. In some embodiments, the first and second openings may be a single opening, the first opening being a first region of the single opening for receiving the first pin, and the second opening being a second region of the single opening for receiving the second pin.

The second pin operates in the reverse direction compared to the first pin to lock the door when the door rotates in the first direction of rotation from open to the closed position. The strike plate has a second opening 226 for receiving the second pin 213 in the extended position when the door is in the closed position. The second pin and the second opening of the strike plate adapted so that the second pin enters the second opening when the door is adjacent to the closed position and moving from the first open position. As the second pin enters the second opening before the door has reached the closed position, movement of the second pin in the second direction of rotation towards the extended position assists movement of the door in the first direction of rotation towards the closed position. Contact between the second pin and an edge of the second opening in the strike plate causes the door to be 'pushed' in the first direction of rotation as the pin rotates in the second direction.

The movement of the first pin 123 is illustrated in FIG. 7. The reader will appreciate the movement of the second pin 223 may be the mirror image of that shown in FIG. 7.

A controller 105 (FIG. 3) controls the first mechanism to move the first pin between the retracted and extended positions and the second mechanism to move the second pin between the retracted and extended positions.

Figure 6A:
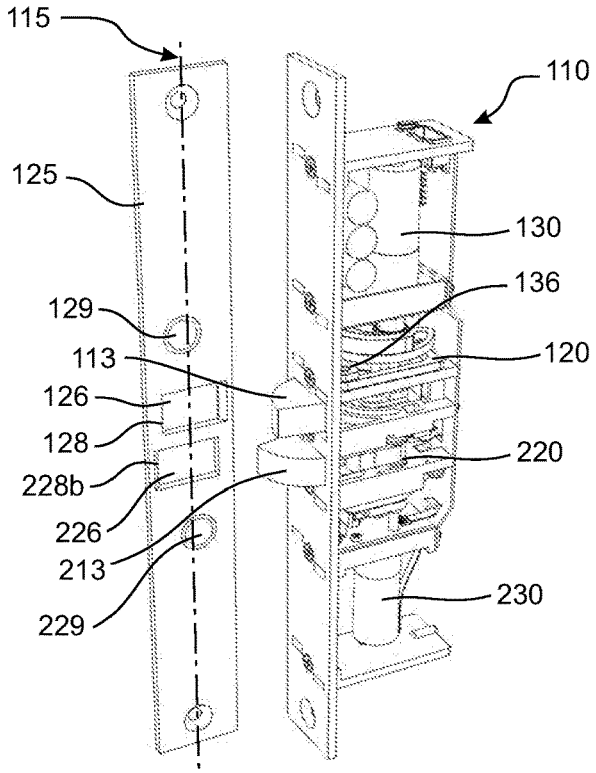
FIG. 6*a* is another perspective view of the lock of FIG. 3 including a strike plate.
Figure 6B:
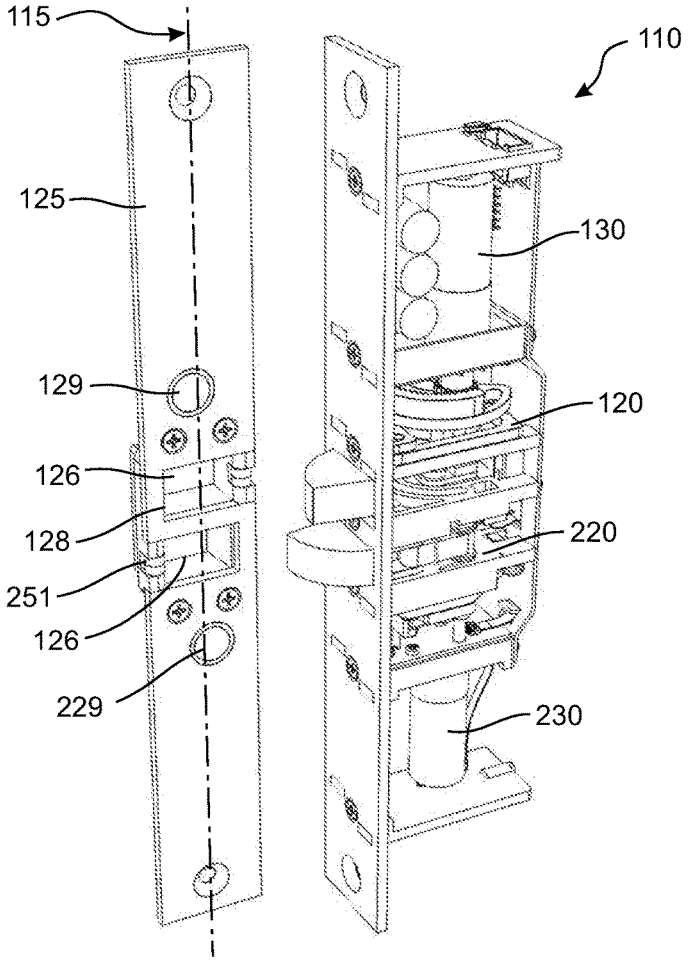
FIG. 6*b* is another perspective view of the lock of FIG. 3 including a strike plate with a roller at each lock pin opening.

Preferably the strike plate 125 comprises a first trigger 129 and a second trigger 229 (illustrated in FIGS. 6*a* and 6*b*). The lock assembly 110 comprises a first sensor 106 for sensing the first trigger and a second sensor 107 for sensing the second trigger. The sensors each provide an output to the controller when the sensor is near to its corresponding trigger. The first and second triggers are offset to opposite side of a centre of the closed position of the door. For example, the door closed position relative to the lock assembly and strike plate is indicated as a centre line 115 of the strike plate 125 in FIGS. 6*a* and 6*b*. For example the door is in the closed position when the centre lines of the lock assembly and the strike plate are approximately aligned.

The first and second triggers 129, 229 are offset with respect to the closed position of the door, one trigger offset to one side of the centre of the door closed position, and the other trigger offset to the other side of the centre of the door closed position. The second trigger is positioned closer to the door first open position than the first trigger so that when the door moves from the first open position to the closed position in the first direction of rotation 123, the second sensor senses the second trigger (for example a magnet as described with reference to FIG. 5) before the first sensor senses the first trigger so that the controller receives an output from the second sensor and actuates the second mechanism 220 to move the second pin 213 from the retracted position to the extended position before the controller actuates the first mechanism 120 to move the first pin 113 from the retracted position to the extended position. This ensures the second pin engages the strike plate before the first pin to ensure the first pin does not clash with the strike plate. If the door moved slowly closed and the first pin extended at the same time as the second pin, the first pin may not align with the first opening 126 and impeded or prevent the door reaching the closed position.

Similarly, since the first trigger is positioned closer to the door second open position than the second trigger, when the door moves from the second open position to the closed position in the second direction of rotation 223, the first sensor senses the first trigger before the second sensor senses the second trigger so that the controller receives a first output from the first sensor and actuates the first mechanism to move the first pin from the retracted position to the extended position before the controller actuates the second mechanism to move the second pin from the retracted position to the extended position.

In an alternative embodiment, the triggers are aligned at the strike plate and the first and second sensors are offset at the lock assembly, so that the sensor and trigger pairs are directionally biased.

Preferably the lock assembly comprises a first motor to move the first pin from the retracted position to the extended position, and a second motor to move the second pin from the retracted position to the extended position.

Lock Assembly Mechanism

The lock assembly 10, 110 comprises a mechanism 20, 120, 220. In one embodiment of the present invention the mechanism operates to support the pin so that a force acting on a locking surface of the pin when the pin is in the extended position is substantially transferred through a structural member of the mechanism and prevent or reduce force acting on a latch for holding the pin in the extended position. In another embodiment the mechanism is adapted to move the pin 13, 113, 213 between the retracted position and the extended position.

An actuator is provided for driving or actuating the pin from the retracted position to the extended position. In one embodiment, the actuator moves the pin via the mechanism. In the preferred embodiment the actuator is a rotational motor 30, 130, 230. The motor is coupled to the pin via the mechanism. The controller drives or actuates the motor to operate the mechanism. The motor is energised to move from a first position to a second position to move the pin from the retracted position to the extended position.

A spring 35, 135, 235 (FIGS. 3, 4 and 5) biases the pin to the retracted position. For example, the spring acts on the mechanism to bias the pin to the retracted position. When moving the pin to the extended position, the motor works against the spring.

A latch 36, 136, 236, when in a latched position, prevents the pin from moving from the extended position to the retracted position. In an unlatched position the latch allows the pin to move from the extended position to the retracted position.

For a door locking operation the controller is programmed to drive the motor in a forward direction from the first position to the second position to move the pin from the retracted position to the extended position. With the pin in the extended position the latch is moved to the latched position to hold the pin in the extended position. With the pin retained in the extended position by the latch, the controller drives the motor to disengage the mechanism from the pin. In the preferred embodiment the motor is driven in a reverse direction from the second position to the first position or an intermediate position between the first and second positions to disengage the motor from the pin.

The lock remains in this locked state, with the latch maintaining the pin in the extended position and the motor driven away from the second position to or towards the first position, until an unlock signal is received by the controller to initiate an unlock operation. For example, the lock may be provided with a push button for a user to operate to unlock a door.

In a door unlocking operation, the controller is programmed to actuate the latch to the unlatch position. Once the latch is moved to the unlatched position and releases the pin, the pin moves to the retracted position under action of the spring. This movement from the extended position to the retracted position occurs rapidly since the motor is disengaged from the pin. In the preferred embodiment, the motor has moved away from the second position to towards the first position before the unlock operation is initiated. Operation of the latch to release the pin and move the pin by a spring force is significantly faster than an arrangement where an actuator strokes the pin from the extended position to the retracted position. A rapid retraction of the pin may not be achieved when using a motor or other energisable actuator to stroke the pin from the extended position to the retracted position is since the motor movement is not as fast as movement under action of a spring which rapidly snaps the pin to the retracted position.

The term 'motor position' used in this specification and claims refers to a relative position of a rotational motor shaft or a moving part of a linear motor or other actuator. For example, the shaft of a motor may turn through one revolution to move from a first (starting) position to a second position. The degrees of movement of a motor shaft between a first position and a second position to move the pin from the retracted position to the extended position depends on a gear ratio between the motor and the pin. In this given example, there are 360° of rotation between the first and second motor positions. In a preferred embodiment of the invention, there is about 288° of rotation (about 80% of one revolution) of the motor shaft to move the motor from the first position to the second position to move the pin from the retracted position to the extended position.

The controller actuates the latch to move the latch to the latched or unlatched positions, via for example a latch actuator. In one embodiment the actuator is a linear actuator, for example a solenoid operated latch bolt. In the preferred illustrated embodiments, the actuator for actuating the pin is also the latch actuator. The motor 30, 130, 230 is energised to both move the pin and operate the latch.

Components of a preferred mechanism are described in detail with reference to FIGS. 8 to 11. Some components of the mechanism (for example supporting walls and the spring 35, 135, 235 illustrated in FIGS. 3, 4 and 5 for biasing the pin to the retracted position) have been omitted from FIGS. 8 and 9 for clarity.

A pinion wheel 50 is attached to a drive shaft of the motor (not shown). The pinion wheel drives a driven member 65 about a shaft 68 via a rack 66 attached to or integrally formed with the driven member. The driven member comprises a projection 67 for triggering a latch described below.

A linkage 44 is coupled to the pin 13. The linkage comprises a first arm 45 and a second arm 46 rotationally coupled together by a linkage shaft 47. The first arm 45 is rotationally coupled to the pin 13 via a first arm shaft 43. The first arm shaft is spaced a distance from the pin shaft 22. The second arm is rotationally supported in spaced relation from the pin by a second arm shaft 48. In the preferred illustrated embodiment, the second arm shaft 48 and the driven member shaft share a common axis. In the preferred illustrated embodiment, the second arm shaft 48 and the driven member shaft are a single (the same) component.

FIGS. 8A and 9A illustrate the mechanism with the pin in the retracted position. With the pin in the retracted position, an angle between the first and second linkage arms is an acute angle. FIGS. 8F and 9F illustrate the mechanism with the pin in the extended position. With the pin in the extended position, the first and second linkage arms are preferably substantially aligned. With the pin in the extended position, the first arm shaft 43, the linkage shaft and the second arm shaft 47 are preferably substantially aligned. With the pin in the extended position, preferably the linkage shaft, the first arm shaft and the second arm shaft are substantially aligned on a line substantially parallel to a plane (60, FIG. 7) of the door when the door is in the closed position.

A force provided to the lock surface of the pin (for example when a load is applied to the door) creates a moment about the pin shaft. As the pin pivots at or on the pin shaft, the moment causes a force to be transmitted into the linkage. With the linkage first and second arms substantially aligned, a significant component of the force is transmitted along the linkage and is reacted at the second arm shaft. Therefore a force applied to the lock surface of the pin is mostly transferred to or reacted by the pin shaft and transmitted through the linkage to a linkage support (the second arm shaft). A force on the locking surface of the pin does not significantly transmit to other components of the mechanism, for example a latch for holding the pin in the extended position or an actuator for driving the pin between the retracted and extended positions.

Figure 10:
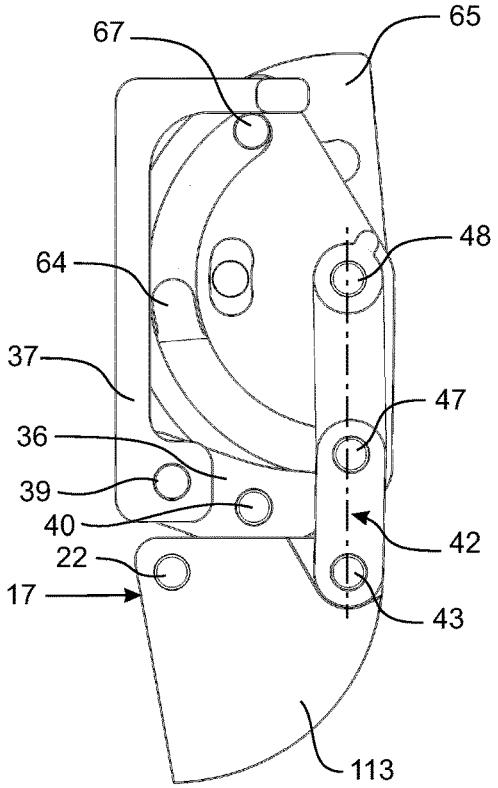
FIG. 10 is a side view of a mechanism of the locks of FIGS. 1 and 3.
Figure 11:
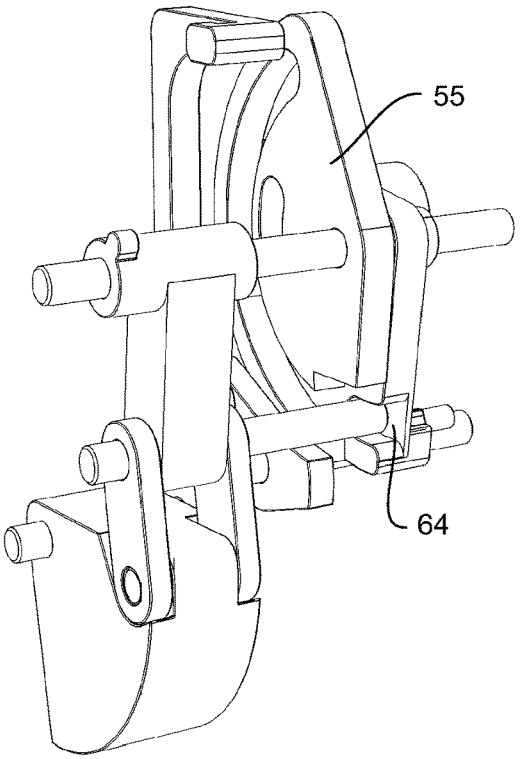
FIG. 11 is the same view as FIG. 8D but with a portion of a component (an unlock cam) cut away so that a recess for receiving a linkage shaft is visible.

Preferably the linkage is adapted so that when moving the pin from the retracted position to the extended position a centre of the linkage shaft 47 passes through a line extending between the centre of the first arm shaft 43 and a centre of the second arm shaft 48 so that in the extended position the angle between the first and second arms is greater than 180 degrees. This position is best shown in FIG. 10. The centre of the linkage shaft 47 has passed through a line 42 extending between the first arm shaft 43 and the second arm shaft 48.

A force provided to the lock surface of the pin (for example when a load is applied to the door) creates a moment about the pin shaft. As the pin pivots at or on the pin shaft, the moment causes a force to be transmitted into the linkage. With an over centre linkage described above, the force acts on the linkage to collapse the linkage in an opposite direction to the direction the linkage collapses when moving the pin to the retracted position. The effect of the over centre linkage is to cause a force on the locking surface of the pin to act on the linkage in an opposite direction to the action of the mechanism spring 35. A force on the locking surface of the pin can overcome the force of the spring. Therefore a significant force on the pin locking surface acts to hold the pin in the extended direction and not push the pin to the retracted position. The over centre arrangement makes the lock significantly robust.

With a force applied to the locking surface of the pin, to retract the pin, it is necessary to move the linkage shaft back through the line extending between the first and second linkage arm shafts so that the pin may be retracted under the force of the spring 35. An actuator initially moves the linkage to retract the pin. In the preferred embodiment the motor initially moves the linkage so that the pin may be retracted under action of the spring.

With the pin in the extended position and with the linkage being over centre, preferably the angle between the first and second arms is slightly greater than 180°. When the linkage is only slightly over centre, the linkage shaft and the first and second arm shafts are substantially aligned. For example, preferably the angle between the first and second arms is between 180° and 181°.

With the linkage slightly over centre so that the linkage is substantially aligned, a force applied to the lock surface of the pin is mostly transferred to or reacted by the pin shaft and transmitted through the linkage. As explained above, any force resulting from a load on the locking surface of the pin does not significantly transmit to other components of the mechanism. With the linkage substantially aligned, the linkage is relatively unstable to a lateral force acting on the linkage at or near to the linkage shaft 47. The linkage can be easily moved by a relatively small force acting laterally on the linkage. Therefore, even when there is a large force acting on the pin locking surface, a relatively small force is required to move the pin from the extended position towards the retracted position, by for example a motor or linear actuator. For example, in the preferred lock, the motor initiates movement of the linkage to retract the pin via an unlock mechanism described below. The motor is capable of initiating retraction of the extended pin when a force of more than 1000N is applied to a door which causes more than 1000N loading on the locking surface of the pin.

The lock comprises a locking mechanism driven by the motor. The locking mechanism is adapted to contact the linkage when the motor is driven in the forward direction to move the pin from the retracted position to the extended position. In the preferred embodiment the locking mechanism is the driven member. The driven member 65 is adapted to contact the linkage 44 when the motor is driven in the forward direction to move the pin from the retracted position to the extended position. The driven member is adapted to contact the linkage shaft 47. The driven member comprises a recess 64 for receiving the linkage shaft. The recess can be partially seen in FIG. 8E. A portion of an adjacent part is cut away in FIG. 11 so the recess 64 is shown clearly, with the linkage shaft 47 received in the recess. The recess is open to a side so that the linkage shaft is released from the recess when the motor is driven in the reverse direction.

The latch comprises a latch arm 36 for retaining the pin in the extended position when the latch arm is in the latched position. In the preferred illustrated embodiment, the latch arm contacts the linkage to retain the pin in the extended position. The latch arm is pivotally mounted on a latch arm shaft 40 to move between the latched and unlatched positions.

A link arm 37 is pivotally connected to the latch arm 36. The link arm and latch arm are pivotally connected via a latch shaft 39. The latch shaft is received in a slot in the latch arm to allow translational movement between the latch arm and the link arm at the pivot point between the link and latch arms.

In the latched position, the latch arm contacts the linkage shaft to retain the pin in the extended position. As shown in FIG. 8E, an end 42 of the latch arm contacts the linkage shaft. In the unlatched position, the latch arm is pivoted about the latch arm shaft to move the end of the latch arm away from the linkage shaft to allow the pin to move from the extended position to the retracted position. The linkage arm is shown in the unlatched position in FIGS. 8G, 9G and 10 where the linkage shaft is free to move past the end 42 of the latch arm 36.

The latch comprises a latch spring 41, 141, 241 (FIGS. 1, 3, 4 and 5) for biasing the latch arm to the latched position. In the illustrated embodiment the spring acts on the linkage arm to bias the latch arm to the latched position. A latch trigger 67 driven by the motor is adapted to move the latch between the latched and unlatched positions. The latch trigger is a projection 67 extending from the driven member 65. Movement of the motor in the reverse direction causes the projection 67 to contact the link arm 37 to shift the position of the link arm to pivot the latch arm from the latched to the unlatched position.

In the preferred embodiment comprising the over centre linkage arrangement, the lock comprises an unlocking mechanism for 'kick starting' movement of the pin from the extended position to the retracted position to overcome the over centre position of the linkage. Preferably the unlocking mechanism is driven by the motor 30, 130, 230. The unlocking mechanism comprises the driven member 65 and driven member projection 67, and an unlock cam 55 comprising a slot 56. The unlock cam is supported on a shaft 54 for rotation about the shaft. In the illustrated embodiment, the unlock cam shaft and the driven member shaft share a common axis. In the illustrated embodiment, the unlock cam shaft and the driven member shaft are a single (the same) component.

A sequence of operation of the lock for extending and retracting the pin is described with reference to FIGS. 8 to 10.

FIGS. 8*a* and 9*a*

The pin 13 is in the retracted position, and the latch 36 is in the unlatched position. The motor is in the first position. The latch is held in the unlatched position by the driven member projection 67 acting on the link arm against the latch spring (not shown in FIGS. 8 and 9). The linkage 44 is in a collapsed position, there being an acute angle between the first 45 and second 46 linkage arms.

FIGS. 8*b* and 9*b*

To extend the pin the motor moves in the forward direction from the first position to the second position. Rotation of the motor drives the driven member 65 via the pinion 50 and rack 66. The linkage shaft 47 is captured by the recess 64 (obscured from view in FIGS. 8*b* and 9*b*) in the driven member so that motor movement straightens the linkage and pivots the pin about the pin shaft 22 to move the pin towards the extended position. The driven member projection 67 has lost contact with the link arm 37. The link arm moves under action of the latch spring 41 and the latch arm 36 pivots about the latch arm shaft to move to the latched position. The driven member projection travels along a slot 56 in the unlock cam 55.

FIGS. 8*c* and 9*c*

The motor has moved closer to the second position. Movement of the driven member continues to straighten the linkage 44. The linkage shaft 47 has contacted the latch arm.

FIGS. 8*d* and 9*d*

As movement of the motor continues the linkage shaft moves over the link arm and drives the link arm to the unlatched position against the action of the latch spring. Contact is made between the linkage shaft 47 and an end 57 of the unlock cam slot 56.

FIGS. 8*e* and 9*e*

The motor has reached the second position. The linkage shaft 47 has passed beyond the end 42 of the latch arm 36 so that the latch arm moves to the latched position under action of the latch spring 41. In the preferred illustrated embodiment, the forward motor movement from FIGS. 8*d*, 9*d* to FIGS. 8*e*, 9*e* has moved a centre of the linkage shaft through a line between the first arm shaft and the second arm shaft as illustrated in and described earlier with reference to FIG. 10. The angle between the first and second linkage arms is more than 180°.

In an alternative embodiment, the centre of the linkage shaft does not pass through a line between the first arm shaft and the second arm shaft, the angle between the first and second linkage arms being less than 180°. In this alternative embodiment, the angle between the linkage arms changes from acute with the pin retracted to obtuse when the pin is extended.

The unlock cam 55 has rotated a small distance about the unlock cam shaft 54, being driven by contact between the end 57 of the unlock cam slot 56 and the linkage shaft 47. The linkage shaft is captured between the end of the latch arm 36 and the end of the slot of the unlock cam 55.

As described above, a force applied to the locking surface of the pin 13 acts against the spring when the linkage is over centre to prevent the pin from moving from the extended position to the retracted position. In one embodiment, a limit to movement of the pin when moving to the extended position is provided by the end 57 of the unlock cam slot 55. For example, rotation of the unlock cam is limited at the position shown in FIGS. 8*e* and 9*e*.

Figure 12:
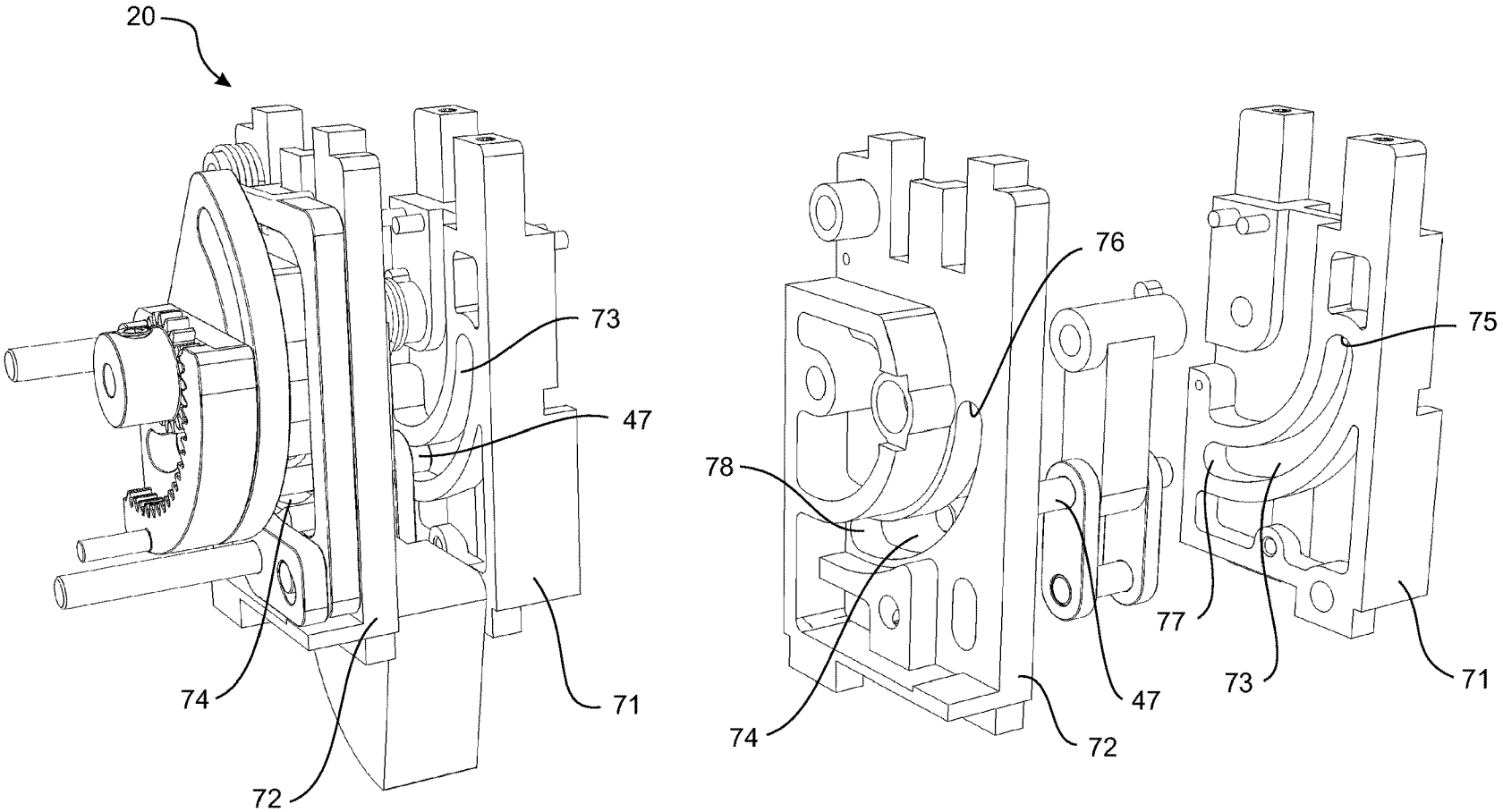
FIG. 12 provides a perspective view of the lock mechanism of FIGS. 8 and 9 including two spaced apart walls omitted from FIGS. 8 and 9, and an exploded view illustrating the walls with a linkage between the walls.

In the preferred embodiment, the extended position is defined by the linkage shaft hitting end stops in two spaced apart walls. FIG. 12 illustrates the mechanism 20 including two walls 71, 72. Walls 71, 72 are omitted from FIGS. 8 and 9 for clarity. As shown in FIG. 12, each end of the linkage shaft 47 is received in a slot 73, 74 in one wall 71, 72. A first end 75, 76 of each slot 73, 74 define a maximum retracted position of the pin. A second end 77, 78 of each slot 73, 74 define a maximum extended position of the pin. In the embodiment of FIG. 3, one wall 71 preferably receives the linkage shaft from both mechanisms 120 and 220. When a large force is applied to the locking surface of the pin and with the linkage over centre, the force on the pin can drive the linkage shaft 47 into the ends 77, 78 of the wall slots. In practice, with the linkage substantially aligned or slightly over centre, the linkage shaft may not contact the ends of the wall slots even when a large force is applied to the pin since the linkage is effectively balanced due to being substantially aligned.

FIGS. 8*f* and 9*f*

The motor has moved in the reverse direction to a position intermediate between the first and second positions. The latch arm 36 retains the pin 13 in the extended position, the end 42 of the latch arm 36 holding the linkage shaft. In the intermediate position, the driven member projection 67 may contact the latch link arm 37 but does not move the link arm so that the latch arm remains in the latched position. The motor is disengaged from the pin by moving the motor in the reverse direction so that the linkage shaft is released from the driven member recess 64 (obscured from view in FIGS. 8*f* and 9*f*).

In an alternative embodiment, the latch may be actuated by a separate latch actuator. In this alternative embodiment where the latch is not operated by the motor, the motor may return to the first motor position with the latch remaining in the latched position.

FIGS. 8*g* and 9*g*

The motor has moved in the reverse direction from the intermediate position to a third position to actuate the latch to move the latch arm 36 to the unlatched position. The driven member projection 67 moves the link arm 37 to pivot the latch arm to the unlatched position.

In the third position, the driven member projection 67 makes contact with a first end 58 of the slot 56 of the unlock cam 55. As explained earlier, the linkage shaft is in contact with a second opposite end 57 of the unlock cam slot. In this position, the unlock cam 55 couples the motor to the pin 13. The unlock cam couples the motor to the pin, one end of the unlock cam shaft in contact driven member projection, and the opposite end of the unlock cam slot in contact with the linkage shaft. The motor is coupled to the pin via the unlock cam and the linkage.

In one embodiment where the linkage is not moved to be over centre when the pin is in the extended position, once the latch is moved to the unlatched position, the pin moves to the retracted position under action of the spring (regardless of whether there is a load on the locking surface of the pin), since the angle between the first and second linkage arms is less than 180°. In this embodiment, the motor may move from the intermediate position to the first position, to actuate the latch from the latched position to the unlatched position to return the pin to the retracted position.

As illustrated in FIGS. 8 and 9, preferably the intermediate is near to the first position, so that a relatively small motor movement is required to operate the latch to the unlatched position and move the pin to the retracted position.

In the preferred illustrated embodiment where the linkage is over centre when the pin is in the extended position, where there is no load on the locking surface of the pin, once the latch is moved to the unlatched position, the pin can move to the retracted position under action of the spring 35 (not shown in FIGS. 8 and 9).

However, as explained above, where there is a load on the locking surface of the pin, the load acts to maintain the pin in the extended position due to the over centre linkage. The load on the pin is transferred into the linkage and overcomes the spring force acting on the mechanism to return the pin to the retracted position, even when the latch arm is in the unlatched position. This state of the mechanism is illustrated in FIGS. 8*g* and 9*g*.

FIGS. 8*h* and 9*h*

When there is a load on the lock surface of the pin and the linkage is over centre, it is necessary to 'kick' the linkage to move the centre of the linkage shaft through a line between the first arm shaft and the second arm shaft so that the force on the pin lock surface works to collapse the linkage in the same direction as the action of the spring.

To achieve this, the motor moves from the third position to the first position. As explained with reference to FIGS. 8*h* and 9*h*, the motor is coupled to the pin via the unlock cam and the linkage. Movement of the motor from the third position to the first position moves unlock cam 55 and therefore the linkage 44 from the over centre position to allow the linkage to collapse under action of the spring and return the pin to the retracted position under action of the spring.

In the preferred illustrated embodiment, the linkage is slightly over centre when the pin is in the extended position. As the linkage is slightly over centre, the link arms are (or first arm shaft, second arm shaft and linkage shaft) are approximately aligned so that a relatively small lateral force is required to 'kick' the linkage from the over centre position to allow the linkage to collapse under action of the spring and a force on the pin surface.

The position of the lock mechanism illustrated in FIGS. 8*h* and 9*h* is identical to the position illustrated in FIGS. 8*a* and 9*a*, with the pin in the retracted position.

The lock preferably comprises a first limit switch, a second limit switch and a third limit switch for communicating to the controller when the motor has reached the first position, the second position and the intermediate position. The motor preferably does not stop movement at the third position when moving from the intermediate position to the first position. The motor passes through the third position when moving from the intermediate position to the first position.

Preferably the driven member comprises a post or feature 63 (FIG. 9*a*) for contacting the limit switches to trip the limit switches.

Preferably the lock also comprises a fourth limit switch and a fifth limit switch for communicating to the controller when the pin has reached the retracted and extended positions. The lock may provide an output for providing a signal to a system for controlling or monitoring the position of the pin being in the retracted or extended positions. The fourth and fifth limit switch are tripped by a feature on the pin or on the mechanism for moving the pin, for example a feature on the linkage or driven member. For example, in the illustrated embodiment a knob 62 (FIG. 8*b*) is provided on the second linkage arm 46 for tripping the pin position limit switches.

In some embodiments, the lock of FIGS. 3, 4 and 6 comprises a first current monitoring circuit for communicating to the controller an electrical current drawn by the first motor, and a second current monitoring circuit for communicating to the controller an electrical current drawn by the second motor. In a door unlocking operation, the controller is programmed to drive the first motor to move the first pin from the extended position to the retracted position and drive the second motor to move the second pin from the extended position to the retracted position. The controller monitors a first electrical current drawn by the first motor and a second electrical current drawn by the second motor required to actuate the first and second pins.

The controller calculates a difference between the electrical currents and compares this difference to a predetermined threshold. For example, the threshold may be set at zero. If the difference is greater than the threshold and the first electrical current is greater than the second electrical current, the controller controls the first and second motors to move the second pin to the retracted position before the first pin. If the difference is greater than the threshold and the second electrical current is greater than the first electrical current, the controller controls the first and second motors to move the first pin to the retracted position before the second pin. For example, if the difference is greater than the threshold and the first electrical current is greater than the second electrical current, the controller stops driving the first motor, and drives the second motor to move the second pin to the retracted position. Once the second pin has reached the retracted position, the controller then drives the first motor to move the first pin to the retracted position. Alternatively, the controller delays commencement of movement of the first motor by a predetermined delay period. Conversely, if the difference is greater than the threshold and the second electrical current is greater than the first electrical current, the controller stops driving the second motor, and drives the first motor to move the first pin to the retracted position. Once the first pin has reached the retracted position, the controller then drives the second motor to move the second pin to the retracted position, or delays movement of the first motor by a predetermined delay period.

This relative control of the first and second pin movement can be important where there is a force applied to the door when closed and locked with the first and second pins in the extended positions and received in the first and second openings in the strike plate. For example, in an installation with the lock assembly 110 installed in a door frame and the strike plate 125 attached to the edge of a door, a force applied in the first direction 123 to the closed and locked door will cause a force on the lock surface of the first pin 113 in the first direction by contact between edge 128 of the first opening 126 and the first pin (FIGS. 6*a* and 6*b*). Due to the substantially aligned linkage and/or over-centre linkage, this force on the extended door pin as illustrated by arrow 17 in FIG. 10 will act to hold the first pin in the extended position and cause the current drawn by the first motor to be higher than the current drawn by the second motor to move the first and second pins. Therefore by comparing the motor currents, the controller can identify a force acting on the door and the direction of that force. Were the controller to continue to energise the first motor and cause the linkages of the first mechanism to collapse and/or move through the centre line of the linkages, the first pin will then move rapidly to the retracted position as it would then be assisted by the force on the pin. This can cause the first pin to retract more quickly than the second pin. With the first pin retracting to the retracted position before the second pin, the force on the door can cause the door to pivot open before the second pin 213 is retracted. In this situation, the strike plate and the second pin can clash, for example an edge (228*b* in FIG. 6*a*) of the second opening can contact a back side (the curved side of the pin in the Figures) of the second pin. This contact on the back side of the second pin will apply a force to the second pin in an opposite direction to the movement of the second pin when retracting to the second position. This force on the back side of the second pin may impede or may stall the movement of the second pin and cause a malfunction of the lock and/or jam the door preventing the door from opening. By controlling the relative movement of the pins as described, the risk of jamming the door on the back side of one of the pins may be reduced or avoided.

Figure 6C:
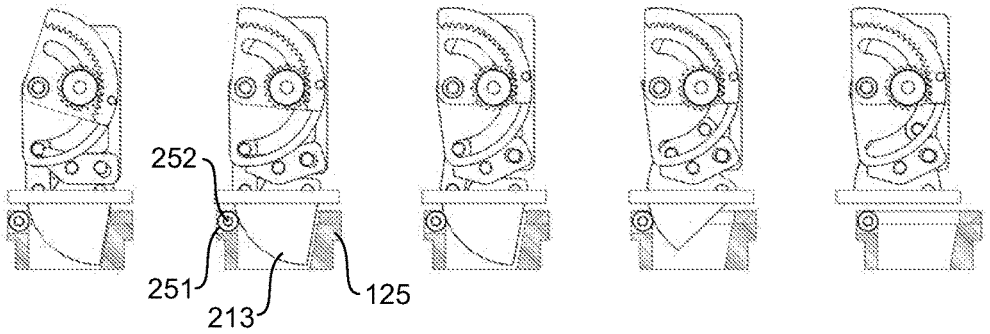
FIG. 6*c* illustrates an unlocking sequence wherein a pin of the lock retracts with a curved back side of the pin contacting a roller of the strike plate.

In some embodiments, the strike plate 125 may comprise a roller or rollers at an edge of the first opening and an edge of the second opening, as illustrated in FIG. 6*b*. Each roller 251 is rotationally mounted to the strike to rotate on a roller shaft (for example shaft 252 in FIG. 6*c*. In an installation with the lock assembly 110 installed in a door frame and the strike plate 125 attached to the edge of a door, a force applied in the first direction 123 to the closed and locked door will cause a force on the lock surface of the first pin 113 in the first direction by contact between edge 128 of the first opening 126 and the lock surface of the first pin (FIG. 6*b*). Once movement of the first pin commences, this force on the extended door pin will act to cause the first pin to move rapidly to the retracted position, as the pin will be assisted by the force on the pin. This can cause the first pin to retract more quickly than the second pin. With the first pin retracting to the retracted position before the second pin, the force on the door can cause the door to start to pivot open before the second pin 213 is retracted. In this situation, the roller 251 of the second opening may contact the curved back side of the second pin 213, as illustrated in FIG. 6*c*. As the roller is rotationally mounted to the strike plate, contact between the curved surface of the second door pin and the roller 251 does not stall the second door pin. The roller rotates as the pin pivots to allow the second pin to retract to the retracted position while there is contact between the pin and the roller.

Similarly, where a force is applied to the door in the second direction 223, contact may occur between the back or curved side of the first pin 113 and the roller 251 due to the second pin retracting to the retracted position before the first pin. The roller 251 rotates as the pin pivots to allow the first pin to retract to the retracted position while there is contact between the pin and the roller.

The rollers 251 reduces or prevents the risk of jamming the door on the back side of one of the pins.

In some embodiments the lock 10, 110, comprises a motor current detection circuit for communicating to the controller an electrical current drawn by the motor 30, 130, 230. In a door locking operation the controller is programmed to monitor the electrical current drawn by the motor and compare the electrical current to a predetermined threshold. The controller drives the motor in a forward direction to move the pin from the retracted position towards the extended position. If the electrical current increases above the threshold, this provides an indication to the controller that the pin has clashed with the door or door frame (or the strike plate attached to the door or door frame). Where the current increases above the threshold, the controller drives the motor in the reverse direction to retract the pin. The motor may drive the motor to the first motor position, or for a determined time period. The motor then drives the pin to the extended position, by which time any door and door frame misalignment may have been corrected (by the door reaching the closed position) and a successful locking operation is achieved. Preferably the controller attempts to successfully extend the pin a predetermined number of times before a fault condition is registered or the lock terminates further attempts to lock the door.

The lock according to the present invention has been described as a lock for locking a door to a door frame. A person skilled in the art will understand that a lock according to the present invention is equally suitable for locking a cupboard door to a cabinet, or any other door to a fixed structure that surrounds the door or is fixed adjacent to the door when in the closed position. The term door frame is intended to be interpreted broadly to cover any frame or structure such as a cupboard wall to which a door may be locked in a closed position. The term door is also intended to be interpreted broadly to mean any barrier moveable between a closed and open position, for example a gate lockable to a fence.

The foregoing description of the invention includes preferred forms thereof. Modifications may be made thereto without departing from the scope of the invention as defined by the accompanying claims.

The invention claimed is:

1. A lock for locking a door, the lock comprising:

a pin moveable between a retracted position and an extended position for locking the door, a motor having a shaft movable from a first position to a second position to move the pin from the retracted position to the extended position, a mechanism comprising:

a spring for biasing the pin to the retracted position, a latch, when in a latched position, prevents the pin from moving from the extended position to the retracted position, and when in an unlatched position, allows the pin to move from the extended position to the retracted position, and the mechanism adapted to disengage the motor from the pin when the pin is in the extended position, a controller, wherein the motor shaft drives the pin from the retracted position to the extended position and the latch is adapted to be operated by the motor, for a door locking operation, the controller is programmed to:

drive the motor shaft in a forward direction from the first position to the second position to move the pin from the retracted position to the extended position and move the latch to the latched position, drive the motor shaft in a reverse direction from the second position to an intermediate position between the first and second positions thereby disengaging the motor shaft from the pin, while the latch maintains the pin in the extended position, and for a door unlocking operation, the controller is programmed to:

drive the motor shaft in the reverse direction from the intermediate position to the first position to move the latch to the unlatched position so as to allow the pin to move to the retracted position under action of the spring.

2. A lock as claimed in claim 1, wherein the intermediate position is adjacent the first position so that a motor shaft movement required to move the latch from the latched position to the unlatched position and move the pin to the retracted position, is smaller than a motor shaft movement required to move the latch from the unlatched position to the latched position and move the pin to the extended position.

3. A lock as claimed in claim 2, wherein the mechanism further comprises a linkage coupled to the pin, the linkage comprising:

a first arm and a second arm rotationally coupled together by a linkage shaft, the first arm rotationally coupled to the pin via a first arm shaft, and the second arm rotationally supported in spaced relation from the pin by a second arm shaft, when the pin is in the retracted position, an angle between the first and second arms is an acute angle or the first arm shaft, the second arm shaft, and the linkage shaft are substantially not aligned, and the linkage is adapted such that when the pin is moved from the retracted position to the extended position, a center of the linkage shaft passes through a line extending between a center of the first arm shaft and a center of the second arm shaft, and when the pin is in the extended position, an angle between the first and second arms is greater than 180 degrees.

4. A lock as claimed in claim 3, wherein the center of the linkage shaft passes through the line extending between the center of the first arm shaft and a center of the second arm shaft, the angle between the first and second arms is less than approximately 181 degrees.

5. A lock as claimed in claim 3, wherein for the door unlocking operation, the controller is programmed to:

drive the motor shaft in the reverse direction from the intermediate position to a third position between the intermediate position and the first position to move the latch to the unlatched position, and drive the motor shaft in the reverse direction from the third position to the first position to move the linkage so that the center of the linkage shaft passes through the line extending between the center of the first arm shaft and a center of the second arm shaft so that the pin moves to the retracted position under action of the spring.

6. A lock as claimed in claim 5, wherein the mechanism further comprises an unlocking mechanism driven by the motor, the unlocking mechanism is adapted to contact the linkage when the motor shaft is in the third position so that movement of the motor shaft from the third position to the first position moves the linkage so that the center of the linkage shaft passes through a line extending between the center of the first arm shaft and a center of the second arm shaft so that the pin moves to the retracted position under action of the spring.

7. A lock as claimed in claim 6, wherein the unlocking mechanism is adapted to contact the linkage shaft.

8. A lock as claimed in claim 6, wherein the unlocking mechanism comprises:

an unlock member driven by the motor shaft, an unlock cam for coupling the unlock member and the linkage when the motor is moved in the reverse direction to the third position.

9. A lock as claimed in claim 8, wherein the unlock member is a driven member driven by the motor, the driven member comprises a projection extending from the driven member, and the unlock cam comprises a slot for receiving the projection, and when the motor shaft is in the third position, the projection bears against a first end of the slot and the linkage bears against a second opposite end of the slot to couple the linkage to the motor via the unlock cam and the driven member.

10. A lock as claimed in claim 6, wherein, the mechanism further comprises a second spring for biasing the latch to the latched position.

11. A lock as claimed in claim 10, wherein the latch comprises a latch arm for contacting the linkage to retain the pin in the extended position, the latch arm is pivotally mounted on a latch shaft to move between the latched and unlatched positions.

12. A lock as claimed in claim 11, wherein the mechanism further comprises a latch trigger driven by the motor for moving the latch between the latched and unlatched positions.

13. A lock as claimed in claim 12, wherein the latch further comprises a link arm pivotally connected to the latch arm, and the latch trigger is a driven member driven by the motor shaft and having a projection, when the motor is in the third position, the projection contacts the link arm to move the latch arm to place the latch in the unlatched position.

14. A lock as claimed in claim 1, wherein the mechanism further comprises a linkage coupled to the pin, the linkage comprising:

a first arm and a second arm rotationally coupled together by a linkage shaft, the first arm rotationally coupled to the pin via a first arm shaft, and the second arm rotationally supported in spaced relation from the pin by a second arm shaft, when the pin is in the retracted position, an angle between the first and second arms is an acute angle or the first arm shaft, the second arm shaft, and the linkage shaft are substantially not aligned, and when the pin is in the extended position, the linkage shaft, the first arm shaft, and the second arm shaft are substantially aligned.

15. A lock as claimed in claim 14, wherein the mechanism further comprises a locking mechanism driven by the motor, the locking mechanism adapted to contact the linkage when the motor shaft is driven in the forward direction to move the pin from the retracted position to the extended position.

16. A lock as claimed in claim 15, wherein the locking mechanism comprises a driven member driven by the motor, the driven member adapted to contact the linkage when the motor shaft is driven in the forward direction to move the pin from the retracted position to the extended position.

17. A lock as claimed in claim 16, wherein the driven member is adapted to contact the linkage shaft, the driven member comprising a recess for receiving the linkage shaft, the recess is open to a side so that the linkage shaft is released from the recess when the motor shaft is driven in the reverse direction to disengage the motor from the pin.

18. A lock as claimed in claim 16, wherein the mechanism further comprises a pinion fixed to the motor shaft, and the driven member comprises a rack engaged with the pinion.

19. A lock as claimed in claim 14, wherein the mechanism further comprises a pair of spaced apart walls with the linkage located in between, each wall comprising a slot or groove for receiving the linkage shaft, ends of the slot or groove define end stops for movement of the linkage.

20. A lock as claimed in claim 14, wherein when the pin is in the extended position, the linkage shaft, the first arm shaft, and the second arm shaft are substantially aligned on a line substantially parallel to a plane of the door when the door is in a closed position.

* * * * *